US010926425B2

(12) United States Patent
Zak et al.

(10) Patent No.: US 10,926,425 B2
(45) Date of Patent: Feb. 23, 2021

(54) SHAVING APPARATUS

(71) Applicant: Hybrid Razor LTD, Caesarea (IL)

(72) Inventors: Shoham Zak, Givat Ela (IL); Beni Nachon, Haifa (IL); Gil Perlberg, Zichron Yaakov (IL); Aviad Dotan, Qoranit (IL); Amit Greener, Tel-Aviv (IL)

(73) Assignee: Hybrid Razor LTD

( * ) Notice: Subject to any disclaimer, the term of this patent is extended or adjusted under 35 U.S.C. 154(b) by 140 days.

(21) Appl. No.: 16/094,500

(22) PCT Filed: Apr. 20, 2017

(86) PCT No.: PCT/IB2017/000525

§ 371 (c)(1),
(2) Date: Oct. 18, 2018

(87) PCT Pub. No.: WO2017/182871

PCT Pub. Date: Oct. 26, 2017

(65) Prior Publication Data

US 2020/0156270 A1 May 21, 2020

Related U.S. Application Data

(60) Provisional application No. 62/325,166, filed on Apr. 20, 2016, provisional application No. 62/325,279, filed on Apr. 20, 2016.

(51) Int. Cl.
*B26B 19/18* (2006.01)
*B26B 19/38* (2006.01)

(52) U.S. Cl.
CPC ..... *B26B 19/18* (2013.01); *B26B 19/3846* (2013.01)

(58) Field of Classification Search
CPC ..... B26B 19/18; B26B 19/3846
(Continued)

(56) References Cited

U.S. PATENT DOCUMENTS 1,981,202 A * 11/1934 Shipman ..... B26B 19/18
30/41.6
2,186,092 A * 1/1940 Benner ..... B26B 19/16
30/43.6

(Continued)

FOREIGN PATENT DOCUMENTS

DE 25 03 175 * 7/1975
FR 2 126 486 * 10/1972

(Continued)

OTHER PUBLICATIONS

International Search Report for corresponding International Application No. PCT/IB2017/000527, dated Sep. 11, 2017.

(Continued)

*Primary Examiner* — Hwei-Siu C Payer
(74) *Attorney, Agent, or Firm* — The Belles Group, P.C.

(57) ABSTRACT

A shaving apparatus 1000 is disclosed in which a rotary cutter 130 and a blade 250 are used to shear a user's hairs therebetween during a shaving process. Various advancements are disclosed herein, including without limitation accurate positioning of the blade relative to the rotary cutter, pivoting of a refill blade assembly 200 relative to a base portion 100 of the shaving apparatus to which it is coupled, and a connection between the refill blade assembly and the base portion of the shaving apparatus. Furthermore, a method of shaving is also disclosed.

17 Claims, 33 Drawing Sheets

(58) Field of Classification Search
USPC ..... 30/43, 43.6
See application file for complete search history.

(56) References Cited

U.S. PATENT DOCUMENTS

| | | | | | |
|---|---|---|---|---|---|
| 2,192,726 | A | | 3/1940 | Williams | |
| 2,229,972 | A | * | 1/1941 | Holsclaw | B26B 19/18 30/43.2 |
| 2,281,922 | A | * | 5/1942 | Dalkowitz | B26B 19/16 30/43.6 |
| 2,367,686 | A | | 1/1945 | Neidig | |
| 2,690,007 | A | | 9/1954 | Neidig | |
| 2,890,523 | A | * | 6/1959 | Bulova | B26B 19/16 30/43.6 |
| 4,151,645 | A | * | 5/1979 | Tietjens | B26B 19/42 30/346.51 |
| 4,733,466 | A | | 3/1988 | Fletcher, Jr. | |
| 4,884,338 | A | | 12/1989 | Stewart | |
| 4,894,912 | A | * | 1/1990 | Tietjens | B26B 19/16 30/43.6 |
| 5,035,053 | A | * | 7/1991 | Hoekstra | B26B 19/16 30/43.6 |
| 5,138,767 | A | | 8/1992 | Locke | |
| 9,862,107 | B2 | * | 1/2018 | Perlberg | B26B 21/34 |
| 10,350,771 | B2 | * | 7/2019 | Perlberg | B26B 19/18 |
| 10,456,935 | B2 | * | 10/2019 | Zak | B26B 21/4081 |
| 2002/0020064 | A1 | | 2/2002 | Kunze | |
| 2012/0000075 | A1 | | 1/2012 | Tsafrir | |
| 2017/0057103 | A1 | | 3/2017 | Perlberg et al. | |
| 2019/0118396 | A1 | | 4/2019 | Zak et al. | |
| 2020/0156270 | A1 | * | 5/2020 | Zak | B26B 19/3846 |

FOREIGN PATENT DOCUMENTS

| | | | |
|---|---|---|---|
| GB | 522153 | * | 6/1940 |
| JP | S5928585 | | 2/1984 |
| JP | 2011087720 | | 5/2011 |
| JP | 2013208389 | | 10/2013 |
| JP | 2014200425 | | 10/2014 |
| WO | 2014/191844 | | 12/2014 |
| WO | WO 2014/191844 A2 | * | 12/2014 |
| WO | 2017/182872 | | 10/2017 |

OTHER PUBLICATIONS

International Search Report for corresponding Application No. PCT/IB2017/000525 dated Oct. 23, 2017. WO.

* cited by examiner

SHAVING APPARATUS

CROSS-REFERENCE TO RELATED PATENT APPLICATIONS

The present application is a U.S. national stage application under 35 U.S.C. § 371 of International Patent Application Serial No. PCT/IB2017/000525, filed Apr. 20, 2017, which in turn claims the benefit of U.S. Provisional Patent Application Ser. No. 62/325,166, filed Apr. 20, 2016, and U.S. Provisional Patent Application Ser. No. 62/325,279, filed Apr. 20, 2016, the entireties of which are hereby incorporated herein by reference.

FIELD OF THE INVENTION

The present invention relates generally to a shaving apparatus, and specifically to a shaving apparatus that utilizes a shearing technique to cut hair bristles between a rotary cutter and a blade.

BACKGROUND

The current methods for removing hair from the human body, by shaving, as opposed to epilation, involve two basic approaches: the razor approach, wherein a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the sharp razor blade approach, the energy for cutting is provided by the hand driving the razor across the skin of the user, typically by the hand of the user him/herself. The conditions of cutting hair are a compromise between the ease of cutting a soft (or softened) hair (or hair bristle) and having the necessary counter-force against the blade's force which can only come from the hardness of the hair bristle. Apart from being a compromise difficult to optimize daily on a variety of hair bristles, the sharpness of the blade and its angle pose a constant risk of nicks and cuts, as the blade is driven forcefully across the skin.

In the screen approach of most motorized shaving apparatus, the problem of safety is mitigated since the skin and the cutting elements are separated by the screen. Moreover, the hair bristles which penetrate the screen through its holes are given a prop to be cut against; hence, the lack of a counter-force for cutting is also mitigated to some extent. However, in order to arrive at an efficient cutting condition, the hair bristle must enter a hole and be perpendicular to the skin, requirements which are not always met unless the screen is constantly moved across the skin. Still, when the hair bristle is eventually cut at the optimal angle, it cannot be cut close to the skin due to the separating screen.

One cutting technique which requires minimal force for cutting hair can be effectuated with scissors. Scissors cut hair at the crossing point of two blades which do not have to be very sharp in order to cut the hair due to the fact that the blades contact the hair from substantially opposite directions in the plane of cutting, mutually providing each other with a counter-force for cutting. However, it is impractical to use scissors for daily shaving. Thus, a need exists for an improved hair cutting apparatus that utilizes a scissor-type cutting technique.

BRIEF SUMMARY OF THE INVENTION

The inventions set forth herein are directed to a shaving apparatus in which a rotary cutter and a blade are used to shear a user's hairs therebetween during a shaving process. Rotation of the rotary cutter is driven by an electric motor. The inventions disclosed herein provide various advancements in such shaving apparatus utilizing a blade and rotary cutter to shear the user's hairs.

In one aspect, the present invention can be directed to a shaving apparatus comprising: a rotary cutter comprising a plurality of cutting edges; a blade having a cutting edge, the blade mounted to a spring member, the blade biased into contact with the rotary cutter by the spring member; and an electric motor operably coupled to a power source and the rotary cutter to rotate the rotary cutter about a rotational axis so that a user's hairs are sheared between the cutting edge of the blade and the cutting edges of the rotary cutter.

In another embodiment, the invention may be a refill blade assembly configured for detachable coupling to and from a shaving apparatus having a base portion, a rotary cutter having a plurality of cutting edges mounted to the base portion so as to be rotatable relative to the base portion about a rotational axis, and an electric motor operably coupled to a power source and the rotary cutter to rotate the rotary cutter about the rotational axis, the refill blade assembly comprising: a cover member; a spring member, a blade mounted to the spring member, the blade having a cutting edge; the spring member connected to the cover member so that the cutting edge of the blade at least partially defines a work window; and the spring member is configured such that when the refill blade assembly is attached to the base portion, the blade is biased into contact with the rotary cutter by the spring member.

In yet another embodiment, the invention may be a refill blade assembly comprising: a cover member; one or more coupling elements configured to detachably couple the cover member to a base portion of a shaving apparatus; a spring member; a blade mounted to the spring member, the blade having a cutting edge; the spring member mounted to the cover member so that the blade is alterable between: (1) a normal state in which the cutting edge of the blade is at a first position relative to the one or more coupling elements; and (2) a biased state in which the cutting edge of the blade is at a second position relative to the one or more coupling elements.

In still another embodiment, the invention may be a shaving apparatus comprising: a base portion; a rotary cutter mounted to the base portion so as to be rotatable relative to the base portion about a rotational axis; an electric motor operably coupled to a power source and the rotary cutter to rotate the rotary cutter about a rotational axis; a blade assembly comprising: a cover member; and a blade having a cutting edge, the blade mounted to the cover member; and the blade assembly coupled to the base portion so as to be pivotable relative to the base portion and the rotary cutter about a pivot axis.

In a further embodiment, the invention may be a refill blade assembly comprising: a cover member comprising a cavity; one or more coupling elements configured to detachably couple the cover member to a base portion of a shaving apparatus in a manner that allows pivoting of the refill blade assembly relative to the base portion while coupled thereto; a blade mounted to the cover member, the blade having a cutting edge; and a work window at least partially defined by the cutting edge of the blade.

In a still further embodiment, the invention may be a shaving apparatus comprising: a base portion; a rotary cutter mounted to the base portion so as to be rotatable relative to the base portion about a rotational axis; an electric motor operably coupled to a power source and the rotary cutter to rotate the rotary cutter about a rotational axis; a blade assembly comprising: a cover member having a first end wall, a second end wall, and a top surface having a work window; the top surface extending from the first end wall to the second end wall, the top surface comprising a first stepped section adjacent the first end wall, a second stepped section adjacent the second end wall, and a raised working section between the first and second stepped sections; and a blade having a cutting edge, the blade mounted to the cover member so that the cutting edge of the blade at least partially defines the work window; and the blade assembly coupled to the base portion, a portion of the rotary cutter exposed via the work window so that a user's hairs are sheared between the cutting edge of the blade and the cutting edges of the rotary cutter when the rotary cutter is rotated about the rotational axis.

In another embodiment, the invention may be a refill blade assembly comprising: a cover member having a first end wall, a second end wall, and a top surface having a work window, the top surface extending from the first end wall to the second end wall; the top surface comprising a first stepped section adjacent the first end wall, a second stepped section adjacent the second end wall, and a raised working section between the first and second stepped sections; and a blade having a cutting edge, the blade mounted to the cover member so that the cutting edge of the blade at least partially defines the work window.

In yet another embodiment, the invention may be a refill blade assembly comprising: a cover member; a blade having a cutting edge, the blade mounted to the cover member; a distal-most working surface that contacts the user's skin during use of the refill blade assembly; a work window in the distal-most working surface, the work window at least partially defined by the cutting edge of the blade; and wherein the working surface has a maximum length (L2) and the cutting edge of the blade has a length (L1); and wherein a ratio of L2:L1 is in a range of 1.0 to 1.3.

In still another embodiment, the invention may be a refill blade assembly comprising: a cover member; a blade having a cutting edge, the blade mounted to the cover member; a distal-most working surface that contacts the user's skin during use of the refill blade assembly; a work window in the distal-most working surface, the work window at least partially defined by the cutting edge of the blade; and wherein the working surface has a maximum length (L2) and the cover member has a maximum length L4; and wherein L4 is greater than L2.

In another embodiment, the invention may be a method of shaving comprising: positioning a working surface of a shaving apparatus against a skin surface, the working surface comprising a blade having a cutting edge, the cutting edge at least partially defining a work window, the shaving apparatus comprising a rotary cutter at least partially exposed via the work window, the rotary cutter rotating about a rotational axis; and moving the working surface of the shaving apparatus across the skin surface so that the cutting edge of the blade is a trailing edge of the blade during said moving, and wherein during said moving hairs protruding from the skin surface are sheared between the cutting edge of the blade and the cutting edges of the rotating rotary cutter as the working surface moves across the skin surface.

In still another embodiment, the invention may be a system for shaving comprising: a shaving apparatus comprising: a rotary cutter comprising a plurality of cutting edges; a blade having a cutting edge that is in contact with an outer surface of the rotary cutter; and an electric motor operably coupled to a power source and the rotary cutter to rotate the rotary cutter about a rotational axis so that a user's hairs are sheared between the cutting edge of the blade and the cutting edges of the rotary cutter; and wherein the user's hairs are sheared between the cutting edge of the blade and the cutting edges of the rotary cutter regardless of a direction of motion of a working surface of the shaving apparatus across a skin surface from which the user's hairs protrude.

Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION

Figure 1:
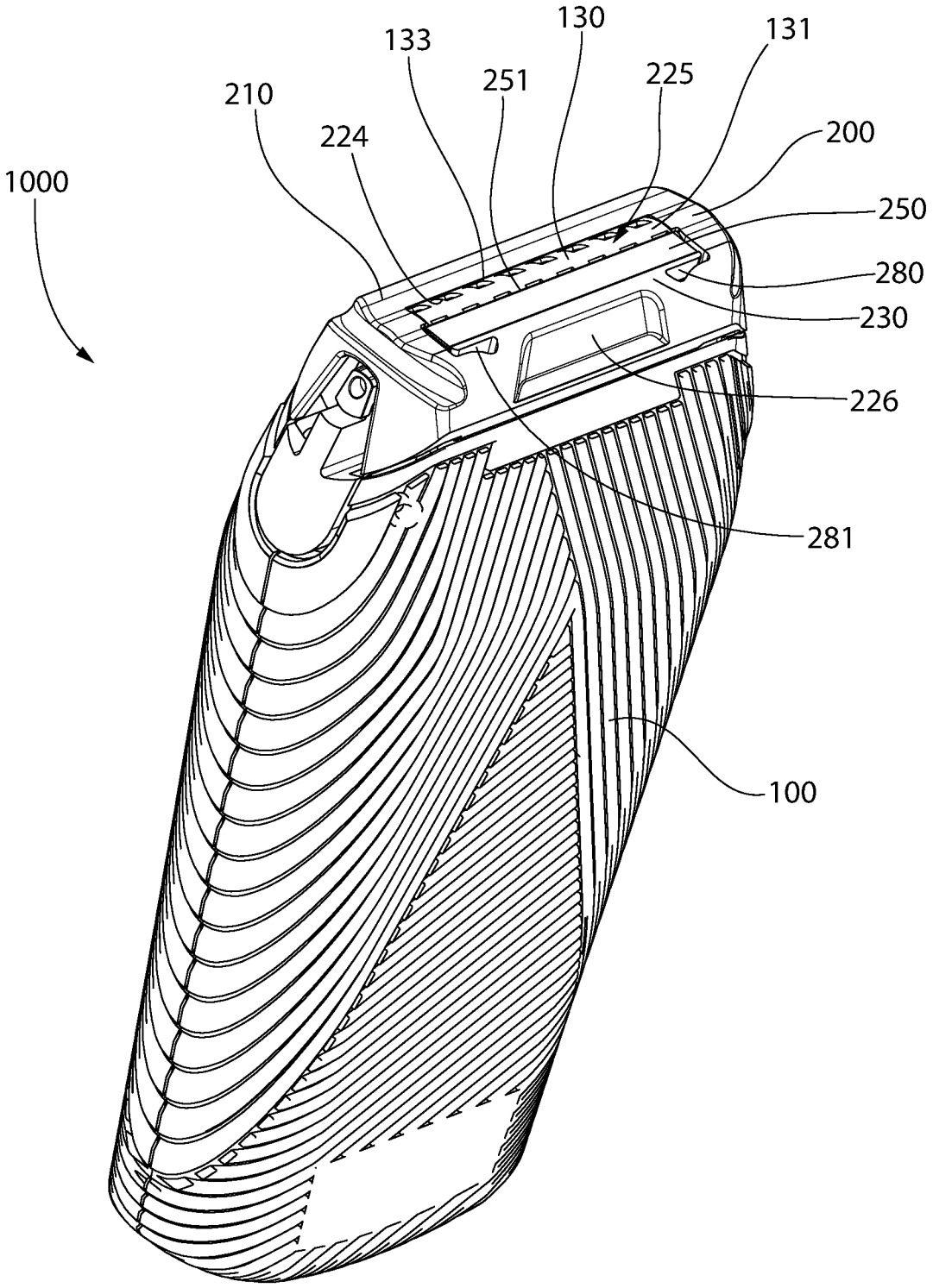
FIG. 1 is a top perspective view of a shaving apparatus in accordance with an embodiment of the present invention.

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Additionally, as used herein, when any two items or axes are said to be "parallel" to "perpendicular" to one another, these terms are intended to include instances where the items or axes are not perfectly "parallel" to "perpendicular" due to tolerances, which may be 1-3° in certain instances.

Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
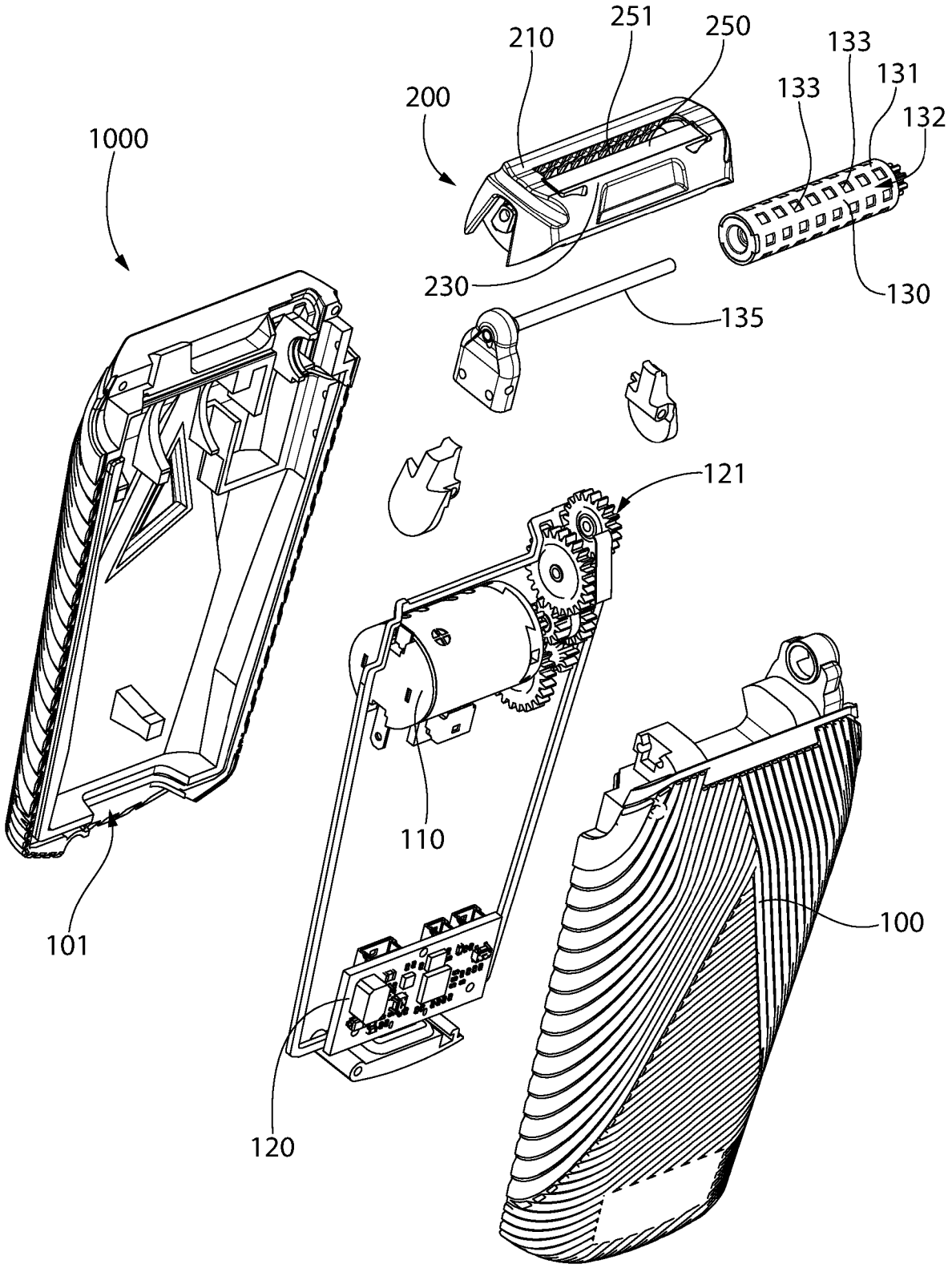
FIG. 2 is an exploded view of the shaving apparatus of FIG. 1.
Figure 3:
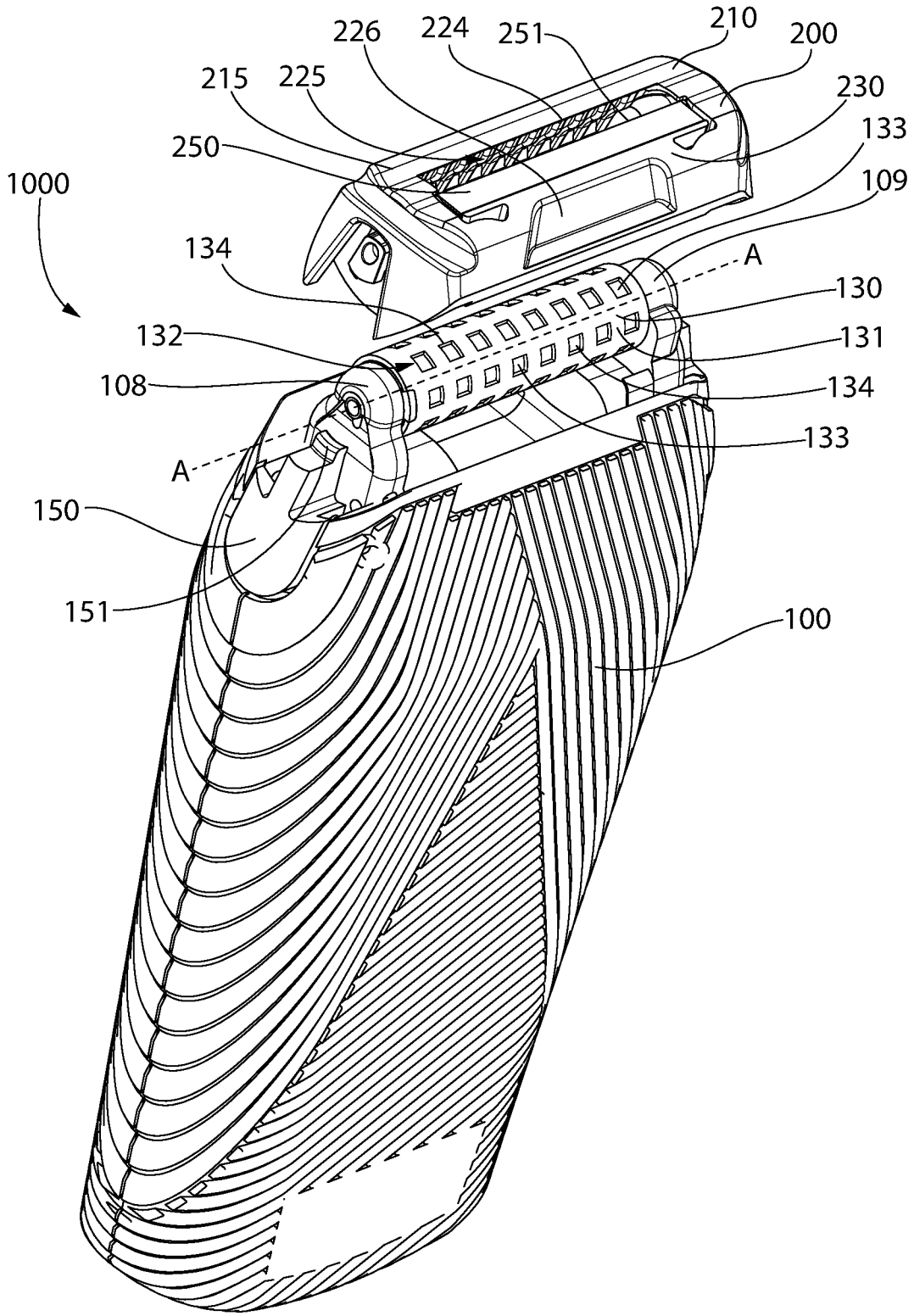
FIG. 3 is a perspective view of the shaving apparatus of FIG. 1 with a refill blade assembly thereof detached from a base portion thereof.
Figure 4A:
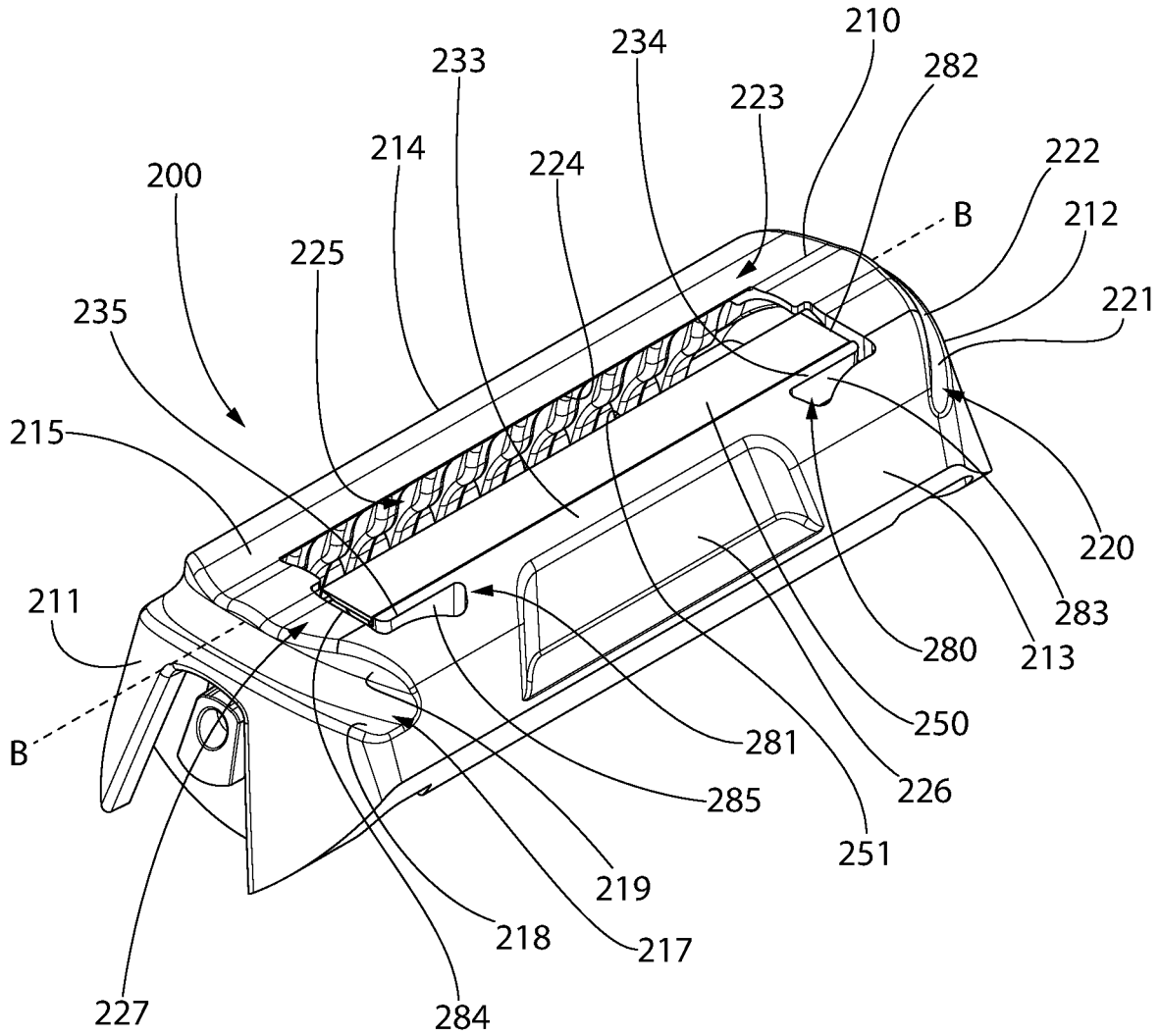
FIG. 4A is a top perspective view of the refill blade assembly of the shaving apparatus of FIG. 1.
Figure 4B:
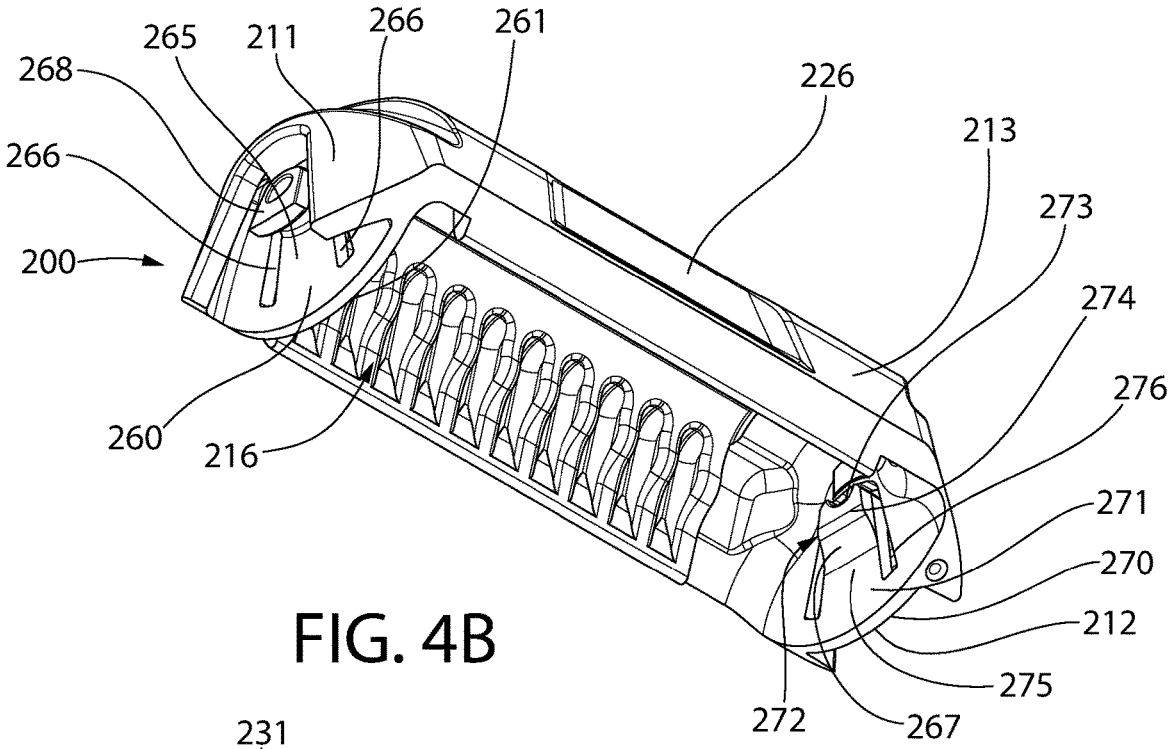
FIG. 4B is a bottom perspective view of the refill blade assembly of FIG. 4A.
Figure 4C:
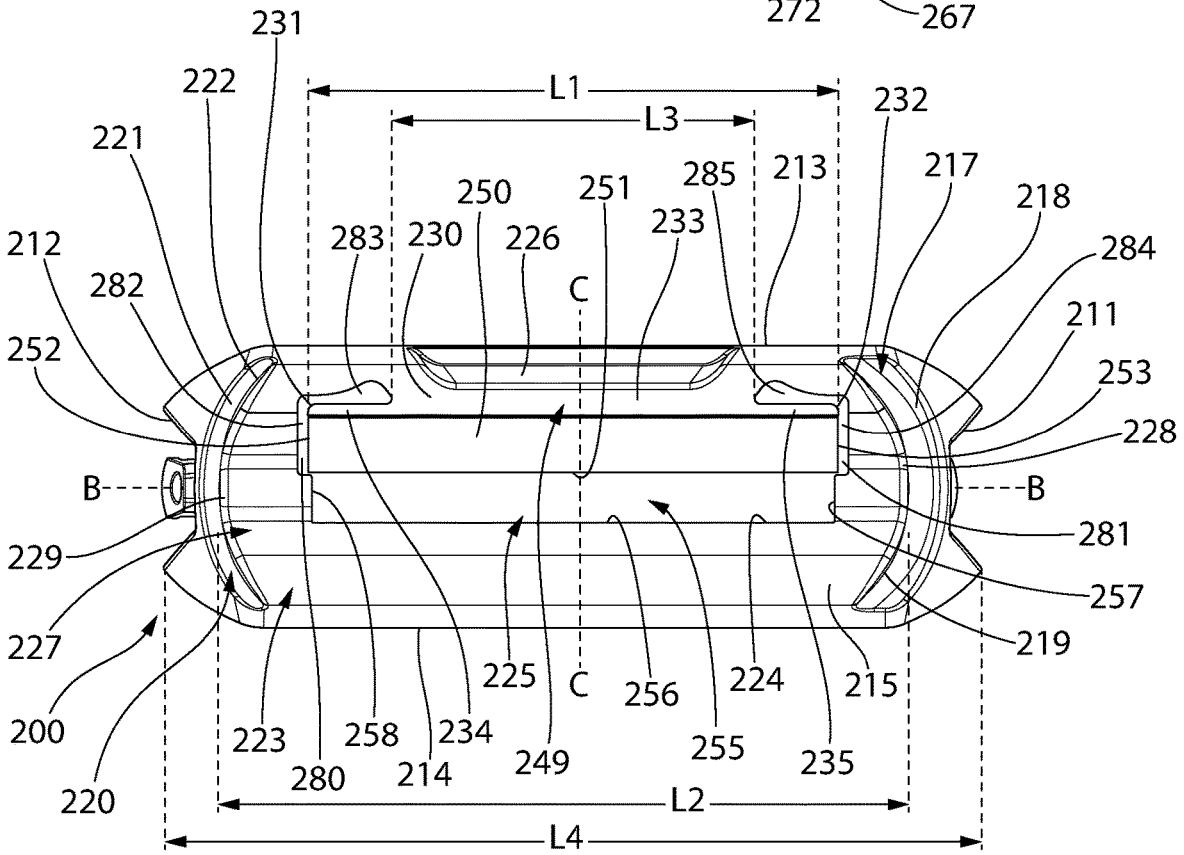
FIG. 4C is a top view of the refill blade assembly of FIG. 4A.
Figure 5:
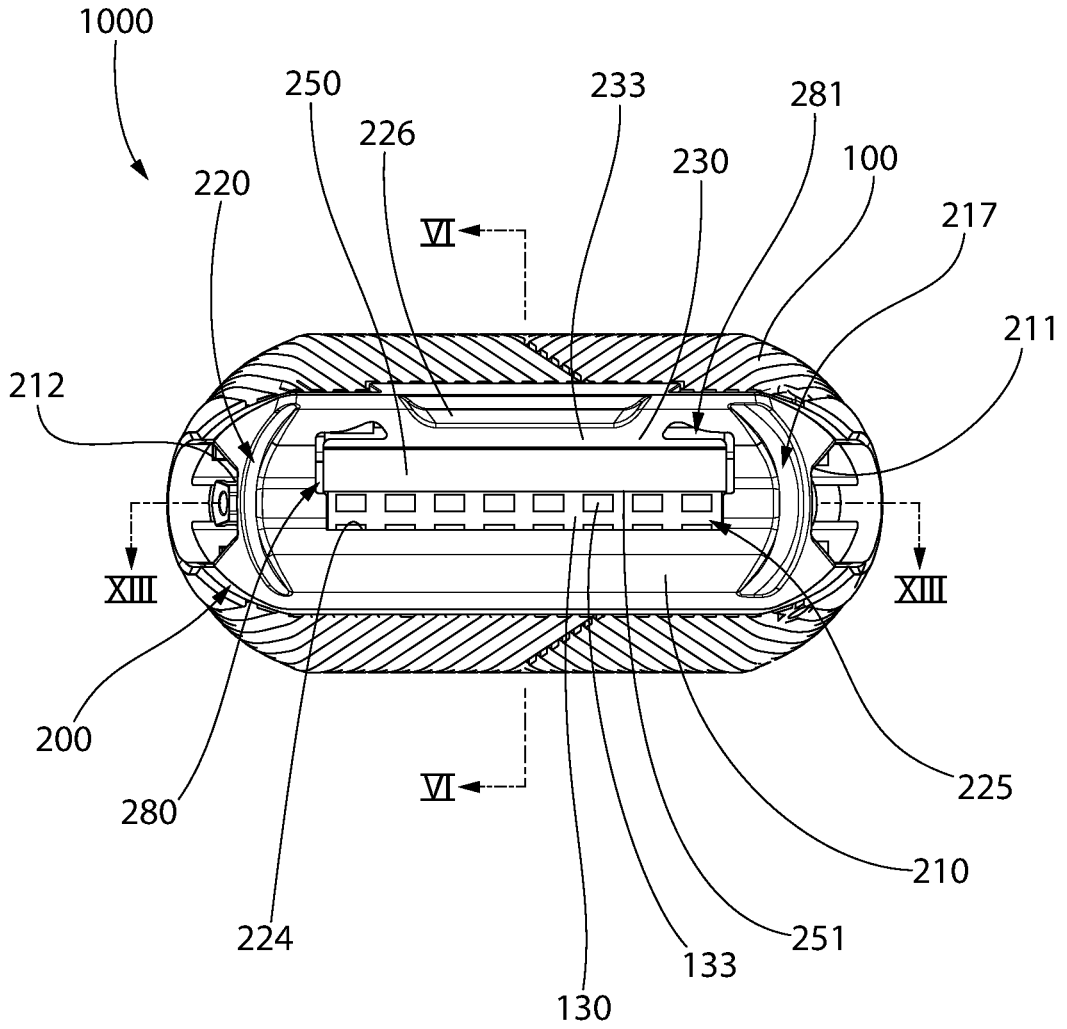
FIG. 5 is a top view of the shaving apparatus of FIG. 1.
Figure 6:
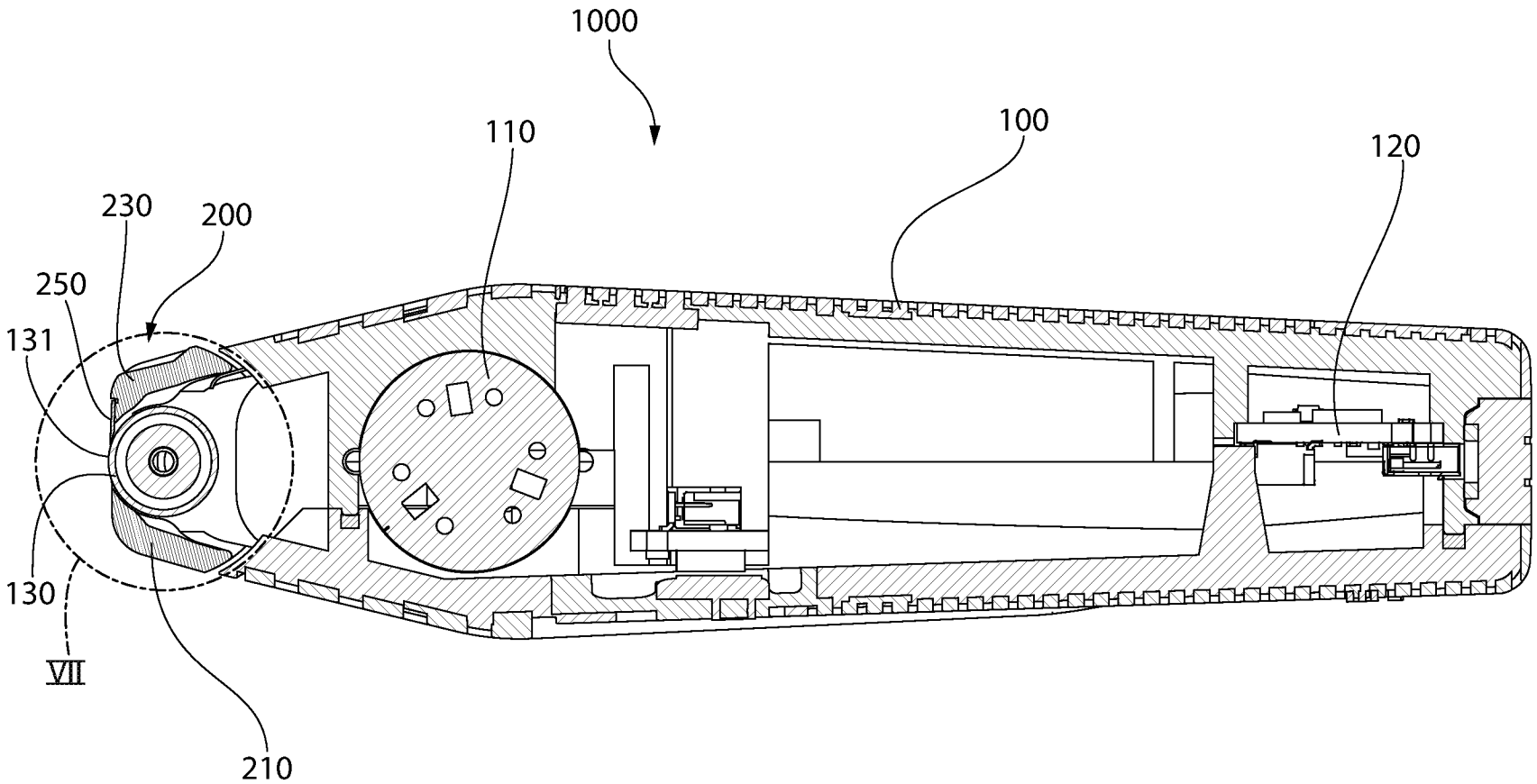
FIG. 6 is a cross-sectional view taken along line VI-VI in FIG. 5.

Referring first to FIGS. 1-3 concurrently, a shaving apparatus 1000 is illustrated according to an embodiment of the present invention. The shaving apparatus 1000 generally comprises a base portion 100 and a refill blade assembly 200. The refill blade assembly 200 may be disposable and replaceable and is detachably coupled to the base portion 100 in such a manner that the refill blade assembly 200 may be repetitively coupled to and detached from the base portion 100 for storage, replacement, or other reasons. Although described herein as being a refill blade assembly, in some embodiments the blade assembly may not be a refill. Thus, although the term "refill" is used before "blade assembly" in most instances, the blade assembly might be a permanent and non-replaceable component of the shaving apparatus 1000 in some embodiments. For example, the blade assembly may be permanently affixed to the base portion 100 such that no portions of the shaving apparatus 1000 are detachable or replaceable. Thus, in the claims the phrase "blade assembly" when not preceded by the term "refill" may include both refill-type blade assemblies and non-refill type blade assemblies.

The base portion 100 forms a handle of the shaving apparatus 1000 that may be readily gripped by a user during a shaving routine. Furthermore, a rotary cutter 130 is mounted to the base portion 100 so that the base portion 100 supports the rotary cutter 130 while permitting the rotary cutter 130 to rotate relative to the base portion 100 about a rotational axis A-A. The rotary cutter 130 is mounted to and rotates about a support shaft 135. The rotary cutter 130 is mounted to mounting arms 108, 109 of the base portion 100 that support the support shaft 135. The base portion 100 of the shaving apparatus 1000 defines an interior cavity 101 that houses a motor 110 (i.e., electric motor), a control circuit 120, a power source (not illustrated), and a gear train 121. The control circuit 120 may comprise a simple switch that permits the shaving apparatus 1000 to transition between "on" and "off" states, or it may include a processor and/or memory for controlling operation of the shaving apparatus 1000. The gear train 121 couples the motor to the rotary cutter 130. Thus, when the shaving apparatus 1000 is powered on, the motor 110 rotates, which in turn causes the rotary cutter 130 to rotate about the rotational axis A-A.

A user-operated actuator, such as a switch, may be provided on the base portion 100 for manually controlling the activation of the motor 110. Examples of user-operated actuators include manual slide switches, capacitance touch-control switches, rotatable knobs, toggle switches, and combinations hereof. Any type of manual or automatic switch can be utilized as would be known by those of skill in the art. In addition to the user-operated actuator, the control circuit 120 may control the performance characteristics of the motor 110. The control circuit 120 can be electric, electronic or mechanical, or any other type of controller that can provide control of the power transmitted to the electric motor 110. The control circuit 120 can also provide decision making for the control of other parts of the shaving apparatus such as, for example, indicator or warning lights or sound generators.

In the exemplified embodiment, the rotary cutter 130 comprises a cutter tube 131 having an outer surface 132. Furthermore, the rotary cutter 130 comprises a plurality of cutting edges 134 formed in the outer surface 132 of the cutter tube 131. In one embodiment, the outer surface 132 of the cutter tube 131 may define a reference cylinder in which the cutting edges 134 of the rotary cutter 130 at least partially lie. In the exemplified embodiment, the cutting edges 134 of the cutter tube 131 at least partially define a plurality of closed-geometry apertures 133 in the outer surface 132 of the cutter tube 131. Specifically, the edges that surround the closed-geometry apertures 133 form the cutting edges 134 of the cutter tube 131 of the rotary cutter 130. The cutter tube 131 may also include one or more apertures that have an open geometry, such as those that might be located near the edges of the cutter tube 131 (not illustrated). Although in the exemplified embodiment the apertures 133 are rectangular or square-shaped, the invention is not to be so limited. In other embodiments, the apertures 133 may be round, triangular, elongated oval, pentagonal, hexagonal, or other polygonal or irregular shapes that have a closed-geometry. All of the apertures 133 in the exemplified embodiment are the same size and shape. In other embodiments, however, the apertures 133 may comprise apertures of a plurality of shapes and/or sizes that are different from one another. In a certain embodiment, each of the apertures 133 is preferably sized and shaped so as to be capable of accommodating at least one hair of the user, which may have a diameter in a range of 15 to 180 microns.

In the exemplified embodiment the refill blade assembly 200 generally comprises a cover member 210, a spring member 230, and a blade 250 having an elongated cutting edge 251. The blade 250 may be referred to herein as a "fixed" blade in some embodiments. However, the term "fixed" is not intended to mean that the blade 250 is completely non-movable relative to the cover member 210 in all embodiments. Rather, in some embodiments discussed herein the blade 250 is mounted to the spring member 230, and thus the blade 250 is movable relative to the cover member 210 due to compression/stretching of the spring member 230. However, the blade 250 is distinguishable from the rotary cutter 130 in that it does not rotate 360° about an axis, but rather stays generally stationary (with the exception of slight movements due to forces acting on the spring member 230) while the rotary cutter 130 rotates. The refill blade assembly 200 is coupled to the base portion 110 so that the blade 250 of the refill blade assembly 200 is in intimate contact with the outer surface 132 of the cutting tube 131 of the rotary cutter 130. As a result, when the rotary cutter 130 is mounted to the base portion 110 and rotated by the motor 110 while the refill blade assembly 200 is coupled to the base portion 110, a user's hairs extend into the apertures 133 of the rotary cutter 130 and are sheared between the cutting edges 134 of the rotary cutter 130 and the cutting edge 251 of the blade 250 during a shaving operation.

As noted above, the refill blade assembly 200 is a disposable component of the shaving apparatus 1000. Thus, as the blade 250 of the refill blade assembly 200 becomes dull or worn over time, the refill blade assembly 200 may be replaced by detaching the refill blade assembly 200 from the base portion 100 and then attaching a new refill blade assembly 200 to the base portion 100. This is similar to razor blade refills on a standard manual razor although the refill blade assembly 200 is more complex due to the fact that the shaving apparatus 1000 is powered and the refill blade assembly 200 must accommodate the rotary cutter 130 as shown and described herein.

Referring to FIGS. 4A-5 and 21, the refill blade assembly 200 will be described in greater detail. As noted above, the refill blade assembly 200 comprises the cover member 210, the spring member 230, and the blade 250. In the exemplified embodiment, the cover member 210 and the spring member 230 are formed of the same material as an integrally formed monolithic structure. Thus, the spring member 230 is built into the refill blade assembly 200 as an integral component thereof. Stated another way, in the exemplified embodiment the spring member 230 is not a separate and distinct component from the cover member 210, but rather they are formed as a one-piece unitary structure. In one embodiment, the cover member 210 and the spring member 230 may be formed of plastic material and the blade 250 may be formed of metal. Thus, the refill blade assembly 200 comprises two parts, the monolithic structure that includes the cover member 210 and the spring member 230, and the blade 250 which is affixed to the spring member 230 of the monolithic structure. Of course, in other embodiments the spring member 230 may be a separate component from the cover member 210, examples of which are described herein below with reference to FIGS. 9-11C.

The cover member 210 generally comprises a first end wall 211, a second end wall 212 opposite the first end wall 211, a front wall 213, a rear wall 214 opposite the front wall 213, and a top wall 215. The refill blade assembly 200 extends along an axis B-B from the first end wall 211 to the second end wall 212. The first end wall 211, the second end wall 212, the front wall 213, the rear wall 214, and the top wall 215 collectively define a cavity 216 having an open bottom end. The cavity 216 is sized and shaped to accommodate the rotary cutter 130 as described in more detail herein below. Specifically, when the refill blade assembly 200 is coupled to the base portion 100, the rotary cutter 130 at least partially nests within the cavity 216 of the cover member 210. Because the bottom end of the cover member 210 is open, the cover member 210, and more specifically the refill blade assembly 200, can be slid over the top end of the base portion 100 of the shaving apparatus 1000. The coupling of the refill blade assembly 200 to the base portion 100 will be described in more detail below with reference to FIGS. 7A-7C and 15A-15F.

The top surface 215 of the cover member 210 extends between the first end wall 211 and the second end wall 212. Furthermore, the top surface 215 of the cover member 210 comprises a first stepped section 217 adjacent the first end wall 211, a second stepped surface 220 adjacent the second end wall 212, and a raised working section 227 extending between the first and second stepped sections 217, 220. Each of the first and second stepped sections 217, 220 form shoulders or depressed sections of the top surface 215 relative to the raised working section 227.

The first stepped section 217 comprises a runner section 218 extending from the first end wall 211 in the direction of the axis B-B and a riser section 219 extending from the runner section 218 to a first end 228 of the raised working section 227 of the top wall 215. The second stepped section 220 comprises a runner section 221 extending from the second end wall 212 in the direction of the axis B-B and a riser section 222 extending from the runner section 221 to a second end 229 of the raised working section 227 of the top wall 215. The runner sections 218, 221 of the first and second stepped sections 217, 220 are depressed or lowered relative to the raised working section 227 of the top surface 215.

In the exemplified embodiment, for each of the first and second stepped sections 217, 220, a concave curvature exists between the riser sections 219, 222 and the runner sections 218, 221. Specifically, each of the first and second stepped sections 217, 220 form arcuate, or more specifically concave notches or cutouts in the top surface 215 of the cover member 210 that face one another. The riser sections 219, 222 are convex surfaces which result in the first and second stepped sections 217, 220 being concave in the direction facing towards a center of the refill blade assembly 200. Of course, in other embodiments the first and second stepped sections 217, 220 may be straight, linear cutouts rather than arcuate as illustrated herein.

The raised working section 227 of the top surface 215 of the cover member 210 in conjunction with a top surface 255 of the blade 250 (and in some embodiments also at least a portion of a top surface 249 of the spring member 230) form a working surface 223 of the refill blade assembly 200 (the working surface 223 is highlighted in FIG. 20 for ease of understanding). The working surface 223 of the refill blade assembly 200 is the surface that contacts a user's skin during a shaving operation. The stepped sections 217, 220 serve to reduce the surface area of the working surface 223 of the refill blade assembly, which better enables the working surface 223 to fit into various face, neck, and other body part contours of a user for a more effective shaving result.

The blade 250 has a length L1 measured in the direction of the axis B-B and the working surface 223 has a maximum length L2 measured in the direction of the axis B-B. The maximum length L2 of the working surface 223 is greater than the length L1 of the blade 250. However, the concave stepped sections 217, 220 decrease the ratio of the length L2 of the working surface 223 to the length L1 of the blade 250. In the exemplified embodiment, the ratio of L2:L1 is between 1.1 and 1.5, more specifically between 1.2 and 1.4, and even more specifically approximately 1.3. In other embodiments, the ratio of L2:L1 may be between 1.0 and 1.3, or more specifically between 1.0 and 1.2, or even more specifically between 1.0 and 1.1. Maintaining the ratio of L2:L1 close to 1.0 helps to maximize the shaving effectiveness, particularly on the neck where it is difficult to reach all crevices and contours. Furthermore, the cover member 210 has an overall length L4 that is greater than the maximum length L2 of the working surface 223.

The cutting edge 251 of the blade 250 is substantially linear and extends substantially parallel to the rotational axis A-A of the rotary cutter 130. The top surface 215 of the cover member 210 terminates in an edge 224 that at least partially faces the cutting edge 251 of the blade 250 in a spaced apart manner. In the exemplified embodiment the edge 224 has a first linear section 256 that is parallel to the cutting edge 251 of the blade 250, and a second and a third linear section 257, 258 that are perpendicular to the first linear section 256 and to the cutting edge 251 of the blade 250.

The cutting edge 251 of the blade 250 and the edge 224 of the top surface 215 of the cover member 210 at least partially define a work window 225 of the refill blade assembly 200. The work window 225 is an elongated slot (elongated along the axis B-B) formed into the top surface 215 of the cover member 210. In the fully assembled shaving apparatus 1000, the rotary cutter 130 protrudes into (and in some embodiments at least partially through) the work window 225. Thus, the rotary cutter 130 is exposed via the work window 225 (see, e.g., FIGS. 7C and 15D) to facilitate a hair cutting procedure as described herein.

The spring member 230 extends from a first end 231 to a second end 232 in a direction of the axis B-B. Similarly, the blade 250 extends from a first end 252 to a second end 253 in a direction of the axis B-B. In the exemplified embodiment, the first ends 231, 252 of the spring member 230 and the blade 250 are aligned and the second ends 232, 253 of the spring member 230 and the blade 250 are aligned. However, the invention is not to be so limited in all embodiments and one of the blade 250 or the spring member 230 may extend further in the direction of the axis B-B than the other in alternative embodiments.

In the exemplified embodiment, the spring member 230 is formed into the refill blade assembly 200 by a first notch 280 that extends from the work window 225 adjacent the first ends 231, 252 of the spring member 230 and the blade 250 and a second notch 281 that extends from the work window 225 adjacent the second ends 232, 253 of the spring member 230 and the blade 250. Thus, the first and second notches 280, 281 extend from the work window 225 on opposite sides of the spring member 230 and opposite sides of the blade 250. In the exemplified embodiment the spring member 230 is a cantilever spring that is fixed only at one end. Of course, the spring member 230 is not limited to being a cantilever spring and may take on other forms in other embodiments, some of which are described herein below with reference to FIGS. 8-12. In the exemplified embodiment, the notches 280, 281 create a reduction in material at the spring member 230, which permits compression of the spring member 230 when forces, such as a downward force or an upward force perpendicular to the top surface of the spring member 230 (, are applied onto the spring member 230. In the exemplified embodiment, the first and second notches 280, 281 have sidewalls that extend perpendicular to the top surface of the cover member 210 (defined by the top wall 215). However, the invention is not to be so limited and in other embodiments the sidewalls of the first and second notches 280, 281 may be formed at an angle relative to the top surface of the cover member 210.

In the exemplified embodiment, each of the first and second notches 280, 281 is an L-shaped notch or slit formed into the refill blade assembly 200. Stated another way, the first notch 280 is a multi-directional notch comprising a first section 282 extending away from the work window 225 towards the front surface 213 of the cover member 210 and a second section 283 extending from the first section 282 towards a transverse centerline C-C of the cover member 210. The second section 283 of the first notch 280 does not extend all the way to the transverse centerline C-C of the cover member 210. Rather, the second section 283 of the first notch 280 extends between 25% and 40%, more specifically between 25% and 35%, and still more specifically between 30% and 33% of the distance from the first end 231 of the spring member 230 to the transverse centerline C-C.

Similarly, the second notch 281 is a multi-direction notch comprising a first section 284 extending away from the work window 225 towards the front surface 213 of the cover member 210 and a second section 285 extending from the first section 284 towards the transverse centerline C-C of the cover member 210. The second section 285 of the second notch 281 does not extend all the way to the transverse centerline C-C of the cover member 210. Rather, the second section 285 of the second notch 281 extends between 25% and 40%, more specifically between 25% and 35%, and still more specifically between 30% and 33% of the distance from the second end 232 of the spring member 230 to the transverse centerline C-C. Thus, the second sections 284, 285 of the first and second notches 280, 281 collectively span approximately one-third of the length of the spring member 230 (which is approximately equal to the length L1 of the blade 250 as noted above).

Of course, in alternative embodiments the second sections 284, 285 of the first and second notches 280, 281 may extend a lesser or greater distance than they do in the exemplified embodiment. Reducing the length of the second sections 284, 285 of the first and second notches 280, 281 will increase the restoring spring force of the spring member 230 whereas increasing the length of the second sections 284, 285 of the first and second notches 280, 281 will decrease the restoring spring force of the spring member 230. The exemplified embodiment has been found to be best suited for ensuring substantially constant contact between the cutting edge 251 of the blade 250 and the rotary cutter 130 is maintained while minimizing the risks of material fatigue due to stresses/strains on the spring member 230 due to use thereof. Furthermore, in some alternative embodiments, one of which will be described briefly below with reference to FIG. 8, the second sections 284, 285 of the first and second notches 280, 281 may be omitted and the first and second notches 280, 281 may only include the first sections 282, 283 thereof. Changing the shape, dimensions, and/or cross-section of the first and second notches 280, 281 will affect the flatness of the blade 250 and the surface on which it is mounted as the spring member 230 flexes. Furthermore, the uniformity of the restoring spring force along an axis parallel to the axis B-B changes as a function of the shape and dimensions of the first and second notches 280, 281. The uniformity of the restoring spring force can be controlled by affecting the shape and dimensions of the first and second notches 280, 281 such that at the center the restoring spring force will be higher than at the ends or the opposite.

In the exemplified embodiment, the second sections 283, 285 of the first and second notches 280, 281 have cross-sectional areas that increase as the second sections 283, 285 extend from the first sections 282, 284. Specifically, the second section 283 of the first notch 280 has a relatively smaller cross-sectional area at its end adjacent the first section 282 of the first notch 280 and a relatively larger cross-sectional area at its opposite end that is located closer to the transverse centerline C-C. Similarly, the second section 285 of the second notch 281 has a relatively smaller cross-sectional area at its end adjacent the first section 284 of the second notch 281 and a relatively lager cross-sectional area at its opposite end that is located closer to the transverse centerline C-C. The second sections 283, 285 of the first and second notches 280, 281 have a somewhat teardrop-like shape in the exemplified embodiment. Of course, this is merely one exemplary embodiment and in other embodiments the notches 280, 281 may have constant cross-sectional areas or may take on other shapes. The cross-sectional areas of the first and second notches 280, 281 may be specifically selected to achieve a desired spring constant or restoring spring force in the spring member 230 while minimizing material fatigue and stress.

In the exemplified embodiment, the spring member 230 comprises a strut portion 233 that is located between the second section 283 of the first notch 280 and the second section 285 of the second notch 281. Furthermore, the spring member 230 comprises a first arm 234 extending from the strut portion 233 to the first end 231 of the spring member 230. The first arm 234 is located adjacent to the second section 283 of the first notch 280 and extends along the length of the second section 283 of the first notch 280. The spring member 230 also comprises a second arm 235 extending from the strut portion 233 to the second end 232 of the spring member 230. The second arm 235 is located adjacent to the second section 285 of the second notch 281 and extends along the length of the second section 285 of the second notch 281.

As illustrated in the drawings, the spring member 230 extends from or is located adjacent to the front wall 213 of the cover member 210. Furthermore, in the exemplified embodiment a depression 226 is formed into the front wall 213 of the cover member 210. The depression 226 makes a portion of the front wall 213 where the spring member 230 is located thinner than the remainder of the cover member 210. This enhances the ability of the spring member 230 to flex and pivot relative to the remainder of the cover member 210. As is known, plastic material may be able to flex to some extent depending on the thickness of the plastic and other design concepts. When the material is thinner, it is better able to flex. Thus, the combination of the depression 226 and the notches 280, 281 creates the spring member 230 that is able to flex and pivot relative to the remainder of the refill blade assembly 200, which advantageously ensures contact between the blade 250 and the rotary cutter 130 is maintained during use for a more effective and consistent cutting result.

In the exemplified embodiment, the spring member 230 has an elaborate and unique shape that enables the spring member 230 of the refill blade assembly 200 to flex and pivot relative to the cover member 210 of the refill blade assembly 200. Of course, as noted above other shapes may be used for the spring member 230 while still achieving the functionality described herein. In the exemplified embodiment, the notches 280, 281 form cutout regions in the refill blade assembly 200, which permits flexing of the material of the refill blade assembly 200 that extends between the first and second notches 280, 281 (i.e., the strut portion 233 of the spring member 230). In this manner, the spring member 230 ensures that contact between the blade 250 and the outer surface 232 of the cutter tube 231 of the rotary cutter 230 is maintained during a cutting operation. Furthermore, the elaborate shape of the spring member 230 has been designed to minimize stress concentration and failure of the plastic material of the refill blade assembly 200 that might otherwise occur due to the vibration of the shaving apparatus 1000 during use.

Figure 7A:
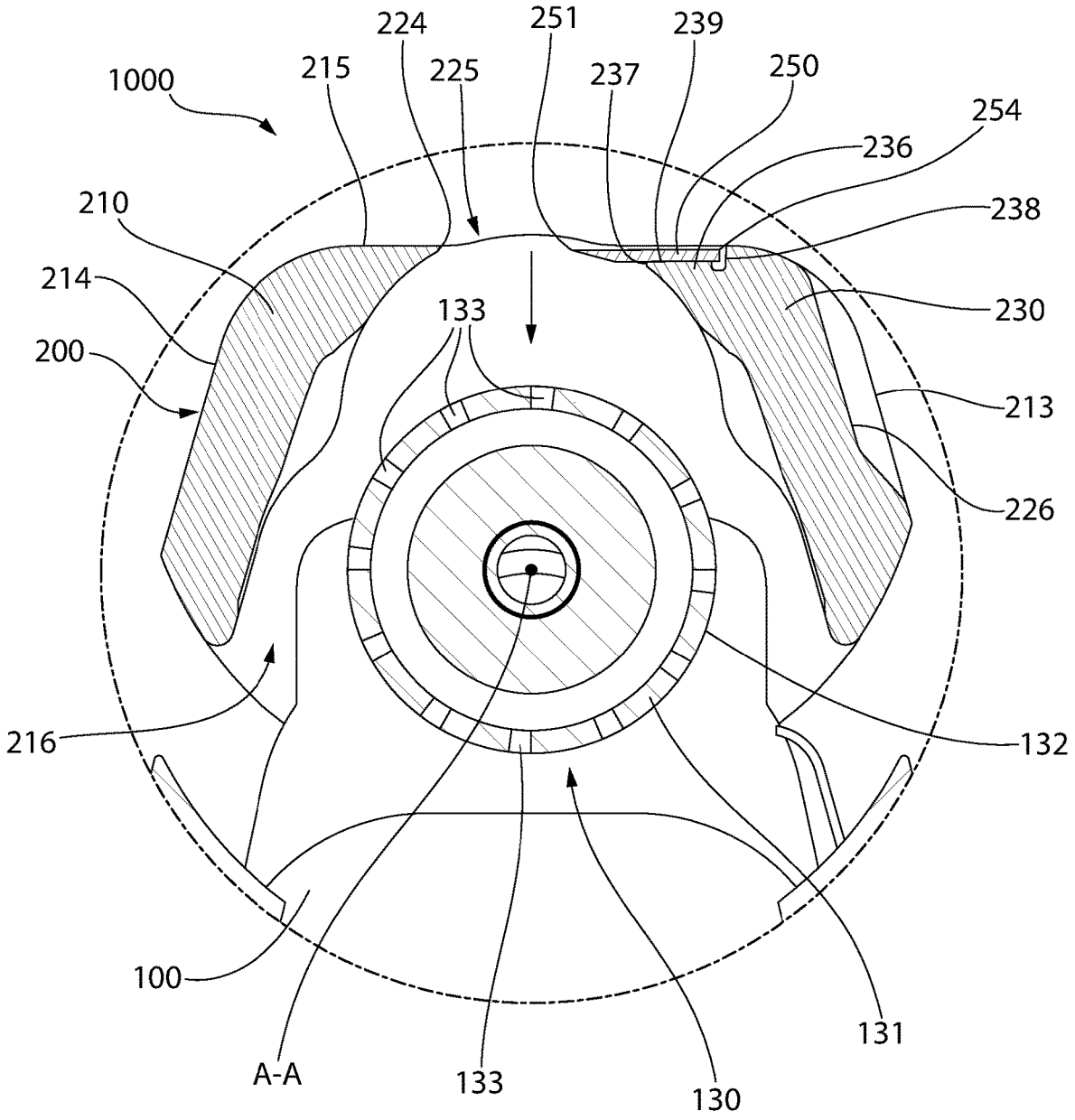
FIG. 7A is a close-up of area VII of FIG. 6 with the refill blade assembly detached from the base portion of the shaving apparatus.
Figure 7B:
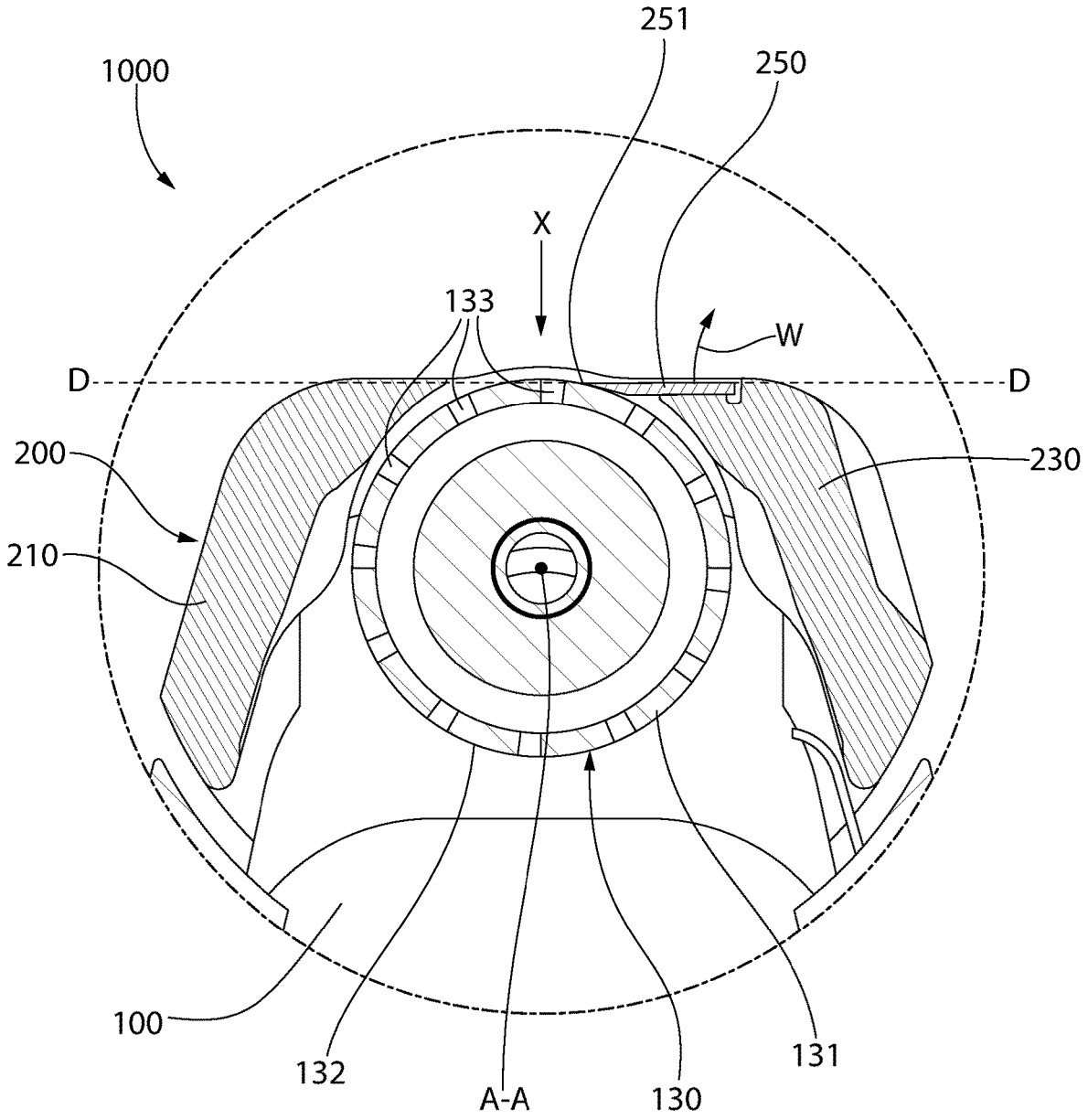
FIG. 7B is a close-up of area VII of FIG. 6 illustrating the refill blade assembly being attached to the base portion of the shaving apparatus.
Figure 7C:
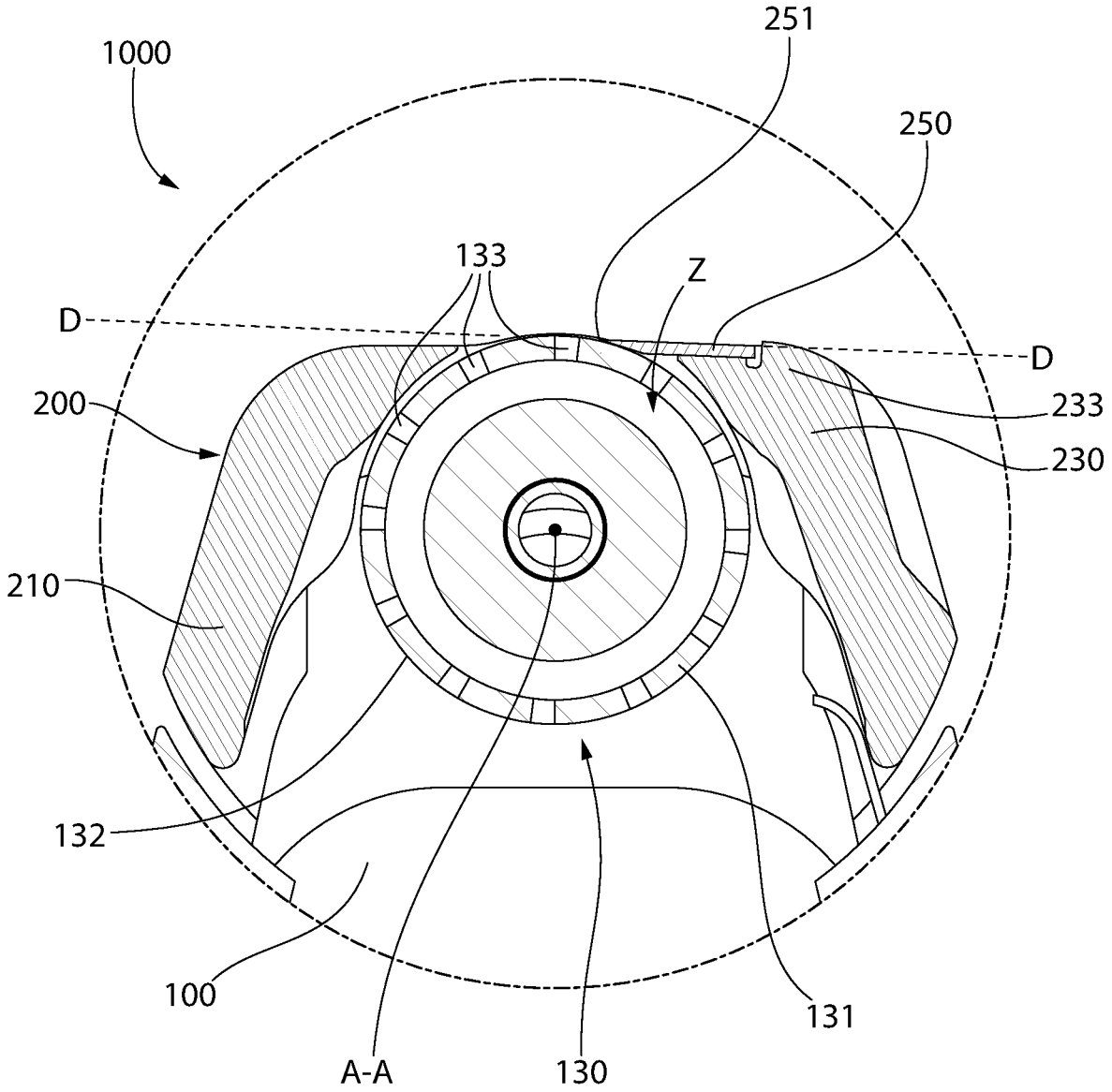
FIG. 7C is a close-up of area VII of FIG. 6 with the refill blade assembly fully attached to the base portion of the shaving apparatus.

Referring to FIGS. 4C and 6-7C concurrently, some additional details of the spring member 230 as well as the deformation/pivoting of the spring member 230 during the coupling of the refill blade assembly 200 to the base portion 100 will be described. As seen in FIGS. 7A-7C, the spring member 230 comprises an upstanding wall 238 and a floor 239 extending from the upstanding wall 238 (these features are labeled in FIG. 7A only to avoid redundancy and clutter). The blade 250 is mounted to the floor 239 of the spring member 230 such that a rear edge 254 of the blade 250 is adjacent to the upstanding wall 238 of the spring member 230. In the exemplified embodiment, there is a small gap between the rear edge 254 of the blade 250 and the upstanding wall 238 of the spring member 230. However, the invention is not to be so limited and in alternative embodiments the rear edge 254 of the blade 250 may abut directly against the upstanding wall 238 such that the upstanding wall 238 forms a registration feature for ensuring proper positioning of the blade 250. Although not illustrated herein, the blade 250 may include a recess or boss on its bottom surface (the surface that is in contact with the floor 239 of the spring member 230) that mates with a recess formed in or a boss extending from the floor 239 of the spring member 230 to secure the blade 250 to the spring member 230. Additionally, or alternatively, the blade 250 may be secured to the floor 239 of the spring member 230 via an adhesive, fasteners, welding, heat staking, or the like.

The spring member 230 comprises a cantilever 236 that terminates in a free end 237. The blade 250 is mounted on the cantilever 236 so that the cutting edge 251 of the blade 250 extends beyond the free end 237 of the cantilever 236. This is so that the cutting edge 251 of the blade 250 is exposed and available for shearing of a user's hairs during shaving. The cantilever 236 has a length that in the exemplified embodiment is the same as the length L1 of the blade 250, although the length of the cantilever 236 may be greater than or less than the length L1 of the blade 250 in other embodiments. Furthermore, the strut 233 has a length L3. In the exemplified embodiment, the length of the cantilever 236 is greater than the length L3 of the strut 233 (in the direction of the axis B-B).

FIG. 7A illustrates the refill blade assembly 200 detached from the base portion 100 but positioned in alignment with the base portion 100 in preparation for attaching the refill blade assembly 200 to the base portion 100. FIG. 7B illustrates the refill blade assembly 200 placed onto the base portion 100 of the shaving apparatus 1000 at the point of first contact between the blade 250 and the rotary cutter 130. Directional arrow X illustrates the direction of movement of the refill blade assembly 200 from FIG. 7A to FIG. 7B. At the first contact between the blade 250 and the rotary cutter 130, the refill blade assembly 200 is not yet fully assembled on and attached to the base portion 100 of the shaving apparatus 100. As can be seen, at the first contact between the blade 250 and the rotary cutter 130, the blade 250 extends along a plane D-D that is substantially parallel to the rotational axis A-A of the rotary cutter 130. At this relative position between the refill blade assembly 200 and the base portion 100, the refill blade assembly 200 can be readily separated from the base portion 100 by simply lifting the refill blade assembly 200 upwardly away from the base portion 100 without needing to "unlock" any coupling members of the refill blade assembly 200 and the base portion 100. Specifically, in this position the refill blade assembly 200 is resting on the base portion, but it is not "locked" in place and cannot (or at least should not) be operated in this position. Pressing the refill blade assembly 200 further in the direction of arrow X relative to the base portion 100 will cause the spring member 230 and the blade 250 to flex in the direction of arrow W.

FIG. 7C illustrates the shaving apparatus 1000 with the refill blade assembly 200 fully assembled on and coupled to the base portion 100. This is the position of the refill blade assembly 200 relative to the base portion 100 during operation and use of the shaving apparatus 1000. Once the refill blade assembly 200 is fully attached to the base portion 100, a user needs to take some action to "unlock" the coupling between the refill blade assembly 200 and the base portion 100 to detach the refill blade assembly 200 from the base portion 100. To get from FIG. 7B to FIG. 7C, as the refill head assembly 200 is press-fit onto the base portion 100, the spring member 230 of the refill blade assembly 200 will pivot about the strut portion 233, thereby maintaining a forceful contact between the blade 250 and the rotary cutter 130. Specifically, the spring member 230 of the refill blade assembly 200 is forced to flex/pivot about the strut portion 233 as the refill blade assembly 200 is press-fit onto the base portion 100 due to the initial contact between the blade 250 and the rotary cutter 130 occurring before the refill blade assembly 200 is fully coupled to the base portion 100. Thus, the rotary cutter 130 applies an upward force onto the blade 250, which in turn causes the spring member 230 to pivot away from its equilibrium position. The notches 280, 281 and depression 226 mentioned previously facilitate this flexing/pivoting of the spring member 230 of the refill blade assembly 200 by permitting the material to bend slightly from its natural or normal state (FIG. 7B) into a biased state (FIG. 7C). Specifically, the spring member 230 may bend from between approximately 2 microns to approximately 100 microns. In some embodiments the spring member 230 may bend from approximately 2 microns to approximately 10 microns, or 20 microns, or 30 microns, or 40 microns, or 50 microns, or 60 microns, or 70 microns, or 80 microns, or 90 microns. As should be appreciated, the cover member 210, and more specifically the refill blade assembly 200, is coupled to the base portion 100 so as to be repetitively alterable between a detached state (FIG. 7A) and an attached state (FIG. 7C).

When the spring member 230 is flexed in this manner and is in the biased state, it wants to move back into its natural or normal state as indicated by the arrow Z. Specifically, the spring member 230 has a built-in restoring spring force because the spring member 230 wants to return to its equilibrium or natural unflexed state. As a result, the spring member 230 forcefully presses the blade 250 against the rotary cutter 130. Stated another way, the blade 250 is biased into contact with the outer surface 132 of the cutter tube 131 due to the blade 250 being mounted on the spring member 230 and the spring member 230 being in a biased state when the refill blade assembly 200 is coupled to the base portion 100 of the shaving apparatus 1000. Thus, the blade 250 is biased into contact with the rotary cutter 130 by the spring member 230. Stated another way, the blade 250 contacts the outer surface 132 of the cutter tube 131 of the rotary cutter 130 with a force due to the restoring spring force of the spring member 130. In the exemplified embodiment, the blade 250 is biased into contact with the outer surface 132 of the cutter tube 131 such that the cutting edge 251 of the blade 250 contacts the reference cylinder defined by the outer surface 132 of the cutter tube 131. In the fully assembled state shown in FIG. 7C, the plane D-D of the blade 250 is no longer parallel to the rotational axis A-A of the rotary cutter 130. Instead the plane D-D of the blade 250 is angled relative to the rotational axis A-A by approximately 1-5°.

Due to the coupling of the blade 250 to the spring member 230, the blade 250 is alterable between a normal state in which the cutting edge 251 of the blade 250 is at a first position relative to coupling elements of the cover member 210 and a biased state in which the cutting edge 251 of the blade 250 is at a second position relative to the coupling elements of the cover member 210 (the coupling elements will be discussed in more detail below). Specifically, the blade 250 is in the normal state when the refill blade assembly 200 is in a detached state relative to the base portion 100. The blade 250 is biased from the normal state into the biased state when the refill blade assembly 200 is attached to the base portion 100 due to contact between the blade 250 and the rotary cutter 130 as described above.

Thus, when the shaving apparatus 1000 is fully assembled with the refill blade assembly 200 coupled to the base portion 100, the blade 250 of the refill blade assembly 200 is in intimate and preferably continuous surface contact with the outer surface 132 of the cutter tube 131 of the rotary cutter 130. This preferably occurs along the entire length of the blade 250 or the cutter tube 131, whichever is shorter. As a result, during use a user's hairs or whiskers will pass into the apertures 133 in the rotary cutter 130 and be sheared between the cutting edges 134 of the rotary cutter 130 and the cutting edge 251 of the blade 250.

As mentioned above, in order to obtain precise shearing, the cutting edge 251 of the blade 250 should be in intimate surface contact with the outer surface 132 of the cutter tube 131 of the rotary cutter 130. The contact between the blade 250 and the rotary cutter 130 forms a friction system. The friction force is determined by the force applied by the blade 250 towards the rotary cutter 130 (due to the spring member 130 and the restoring spring force noted above). The friction force may vary dynamically if, for example, the rotary cutter 130 is not perfectly round or is unbalanced in its rotation or due to wear and tear of the rotary cutter 130 and/or blade 250 over time or due to material fatigue. The spring member 230 maintains the friction force substantially constant even after some wear and tear or material fatigue.

The length of the contact line between the blade 250 and the rotary cutter 130 is approximately equal to the shorter of those two components as measured in the direction of the axis B-B. In the exemplified embodiment, the length of the blade 250 and the rotary cutter 130 is substantially equal. The spring member 230 of the refill blade assembly 200 biases the blade 250 into contact with the outer surface 132 of the cutter tube 131 of the rotary cutter 130 either along the entire length of the blade 250, along the entire length of the rotary cutter 130, or both. Cutting of hairs is achieved along the entirety of the contact line between the rotary cutter 130 and the blade 250, and thus having the contact line extend the entire length of the rotary cutter 130 and/or the blade 250 ensures a maximum of cutting potential is reached.

In certain embodiments, when the refill blade assembly 200 is in the fully assembled state as illustrated in FIG. 7C, the blade 250 applies a restoring spring force of approximately 0.05-2 kgf due to the biasing of the spring member 230. In other embodiments, the restoring spring force may be in a range of 0.05-0.15 kgf, 0.1-0.25 kgf, 0.25-0.5 kgf, or 0.5-2 kgf. The restoring spring force may have a normal variation of +/−2%, 5%, 10%, 25% in some embodiments. The contact between the blade 250 and the rotary cutter 130 may be interrupted for short periods of time, for example 0 to 1000 ms, due to vibration of the rotary cutter 130 during operation or due to temporary lifting of the blade 250 during shearing of hairs or due to debris getting stuck on the rotary cutter 130 or the blade 250. The bias of the spring member 230 ensures that any period of time in which the contact is interrupted is very short. It should be appreciated that the restoring spring force is a function of the amount or degree of displacement of the spring member 230. A typical displacement might be, in some embodiments, between 0.01 mm and 0.02 mm. Furthermore, the spring member 230 has a spring constant, which is the restoring spring force divided by the displacement distance. Thus, based on the restoring spring forces above and based on a displacement of 0.02 mm, the range of spring constants for the spring member 230 may be readily calculated.

Figure 8:
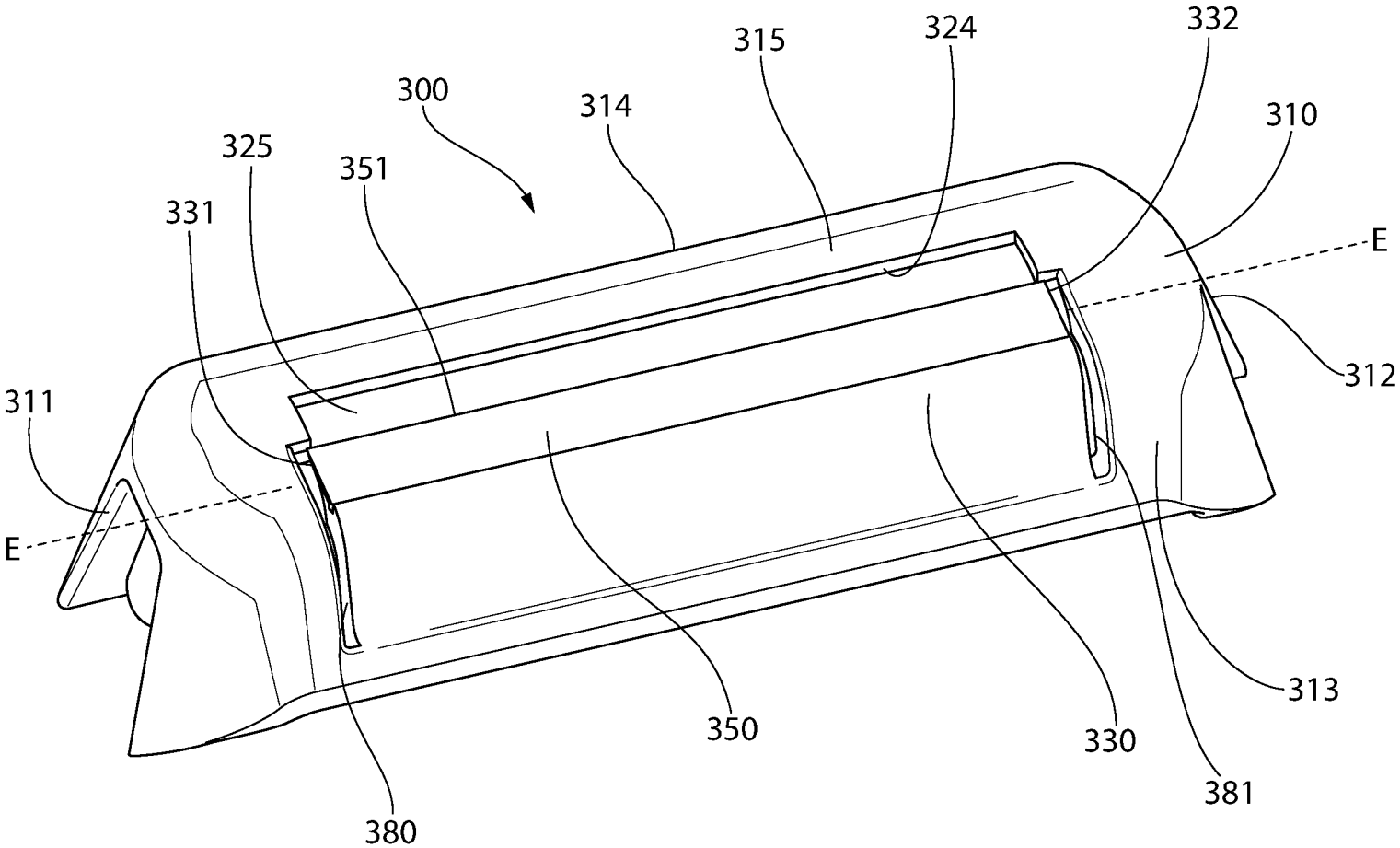
FIG. 8 is a top perspective view of a refill blade assembly in accordance with an alternative embodiment of the present invention.

Referring briefly to FIG. 8, an alternative embodiment of a refill blade assembly 300 is illustrated. The refill blade assembly 300 is similar to the refill blade assembly 200 described above. Thus, features of the refill blade assembly 300 that are similar to the refill blade assembly 200 will be similarly numbered, except that the 300-series of numbers will be used. For features of the refill blade assembly 300 that are numbered but not mentioned or described in this section, the description of the similar feature with regard to the refill blade assembly 200 is applicable. Furthermore, for features of the refill blade assembly 300 that are neither numbered nor described, the description of the similar feature of the refill blade assembly 200 applies.

The refill blade assembly 300 generally comprises a cover member 310, a spring member 330, and a blade 350. The blade 350 is coupled to a cantilever of the spring member 330 in a similar manner to that which has been described above. The cover member 310 comprises a first end wall 311, a second end wall 312 opposite the first end wall 311, a front wall 313, a rear wall 314 opposite the front wall 313, and a top wall 315. The blade 350 terminates in a cutting edge 351 that faces and opposes an edge 324 of the top wall 315 of the cover member 310. The cutting edge 351 of the blade 350 and the edge 324 of the top wall 315 collectively at least partially define a work window 325 through which a rotary cutter (such as the rotary cutter 130 described above) is exposed. A user's hairs or whiskers are sheared between the cutting edge 351 of the blade 350 and cutting edges of the rotary cutter in much the same way as has been described above.

The main difference between the refill blade assembly 300 and the refill blade assembly 200 is in the construction of the spring member 330. The spring member 330 extends from a first end 331 to a second end 332 along an axis E-E. Furthermore, in this embodiment the spring member 330 is defined by a first notch 380 located adjacent the first end 331 of the spring member 330 and a second notch 381 located adjacent the second end 332 of the spring member 330. In this embodiment, the first and second notches 380, 381 are linear notches or slits that extend in a direction perpendicular to the axis E-E. The notches 380, 381 are not multidirectional as with the previous embodiment, but merely extend in a single direction. The notches 380, 381 still permit the spring member 330 of the refill blade assembly 300 to flex or pivot between its natural state and a biased state. Specifically, when a force is applied onto the blade 350, which is mounted on the spring member 330, during attachment of the refill blade assembly 300 to the base portion 100, the force of the rotary cutter on the blade 350 will cause the blade 350 to move from the normal state to the biased state due to the flexibility permitted by the spring member 330. Thus, FIG. 8 merely illustrates another embodiment whereby the shape of the spring member 330 and the notches 380, 381 is not quite as complex as with the previous embodiment.

Figure 9:
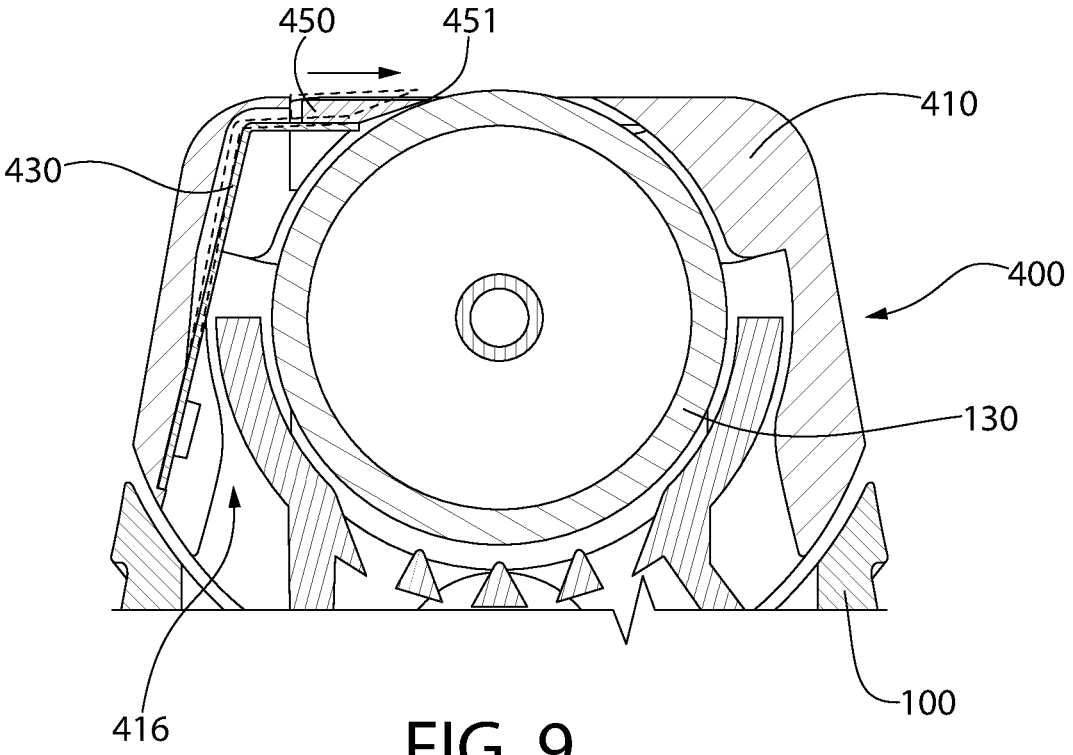
FIG. 9 is a schematic cross-sectional view of a portion of a shaving apparatus illustrating a spring member in accordance with an alternative embodiment of the present invention.

Referring now to FIG. 9, a head portion of a shaving apparatus is illustrated to show another alternative embodiment of a refill blade assembly 400. The refill blade assembly 400 is similar to the refill blade assembly 200 described above. Thus, features of the refill blade assembly 400 that are similar to the refill blade assembly 200 will be similarly numbered, except that the 400-series of numbers will be used. For features of the refill blade assembly 400 that are numbered but not mentioned or described in this section, the description of the similar feature with regard to the refill blade assembly 200 is applicable. Furthermore, for features of the refill blade assembly 400 that are neither numbered nor described, the description of the similar feature of the refill blade assembly 200 applies.

The refill blade assembly 400 generally comprises a cover member 410, a spring member 430, and a blade 450 mounted to the spring member 430. In FIG. 9, the refill blade assembly 400 is illustrated in a state in which it is attached to the base portion 100 of the shaving apparatus to illustrate the relationship between the blade 450 and the rotary cutter 130. The main difference in this embodiment is that the spring member 430 and the cover member 410 are not formed integrally as a monolithic structure. Rather, in this embodiment the cover member 410 is a first component preferably formed of a plastic material and the spring member 430 is a second component preferably formed of a metal material. Thus, the spring member 430 is a separate component than the cover member 410. In this embodiment, the blade 450, which terminates in a cutting edge 451, is mounted to the spring member 430 and then the spring member 430 with the blade 450 mounted thereto is coupled or mounted to the cover member 410 to form the refill blade assembly 400.

In this embodiment, the spring member 430 is mounted to the cover member 410 within a cavity 416 of the cover member 410. In this embodiment, the spring member 430 is entirely mounted on the inside of the cover member 410 such that only the blade 450 is exposed to the user. The spring member 430 may be coupled to the cover member 410 in any manner, including mechanical means such as boss/hole (illustrated in FIG. 9 with the boss on the inner wall of the cover member 410 and a hole to receive the protuberance formed into the spring member 430, although the boss could be on the spring member 430 and the hole on the cover member 410 in other embodiments), interlocking or mating members, or the like, or via adhesive, gluing, welding, brazing, heat staking, fasteners, bolts, screws, nails, or the like.

The natural/normal state of the spring member 430 is illustrated in solid lines in FIG. 9. As the refill blade assembly 400 is mounted onto the base portion 100, the blade 450 contacts the rotary cutter 130 as described earlier. As the refill blade assembly 400 continues to be pressed into the base portion 100 to fully attach the refill blade assembly 400 to the base portion 100, the force of the rotary cutter 130 against the blade 450 will cause the spring 430 to flex into a biased state, illustrated in dotted lines in FIG. 9. This is the fully assembled state, and in this state the spring member 430 biases the blade 450 into contact with the rotary cutter 130 so that contact between the blade 450 and the rotary cutter 130 is maintained as described herein above. This is because the spring member 430 stores mechanical energy and is constantly attempting to return from the biased state back into the natural or normal state due to the restoring spring force of the spring member 430.

Figure 10:
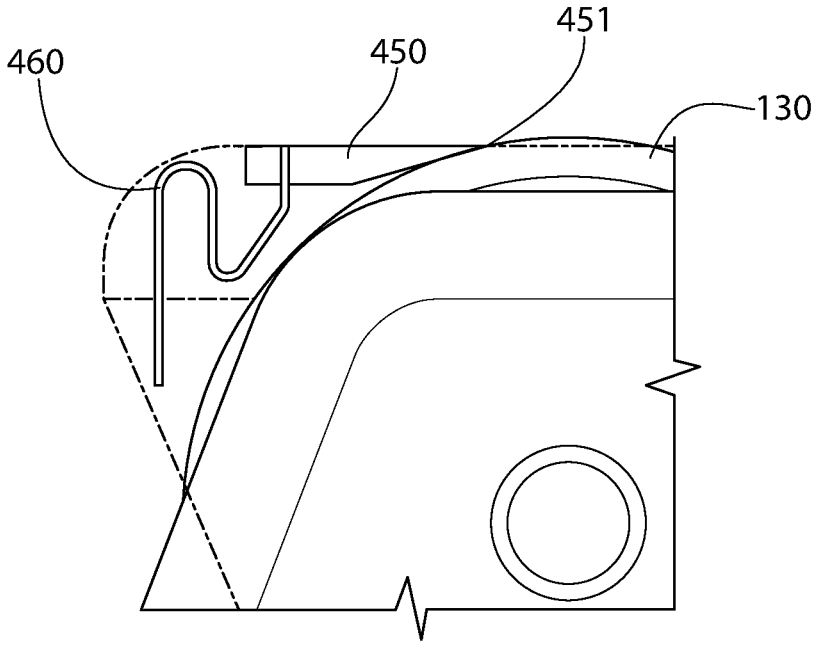
FIG. 10 is a schematic illustration of a portion of a shaving apparatus illustrating a spring member in accordance with another alternative embodiment of the present invention.
Figure 11A:
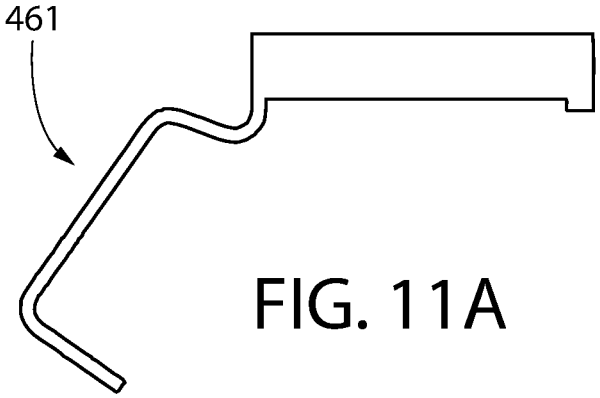
FIGS. 11A-11C illustrative alternative spring members that may be used with the shaving apparatus of the present invention.
Figure 11B:
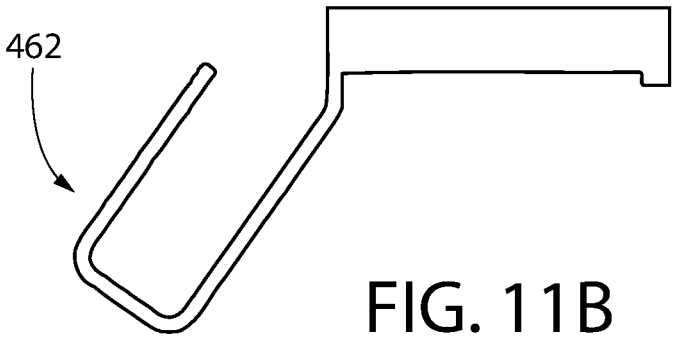
Figure 11C:
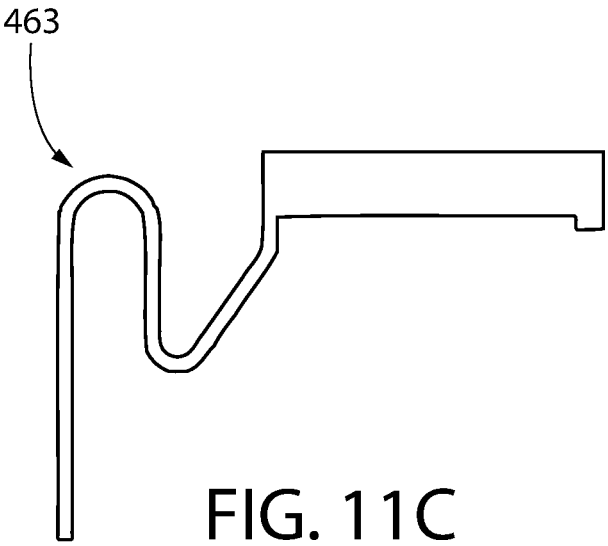

FIG. 10 schematically illustrates another embodiment that is similar to the embodiment of FIG. 9. In this embodiment, the spring member 460 is again a metal spring that is a separate component from the cover member 410. However, the spring member 460 has a different configuration/shape than the spring member 430. FIGS. 11A-11C illustrate additional spring members 461, 462, 463 having different configurations/shapes. As shown in FIGS. 10-11C, convoluted bends may be used to further increase the length of the spring members 460-463 without materially altering the external dimensions of the shaving apparatus 1000. U-shaped and S-shaped bends may be particularly valuable for providing a reduced spring constant without requiring excessive thinning of the spring material. Strain on the spring may also be reduced by increasing the cantilever length.

Figure 12:
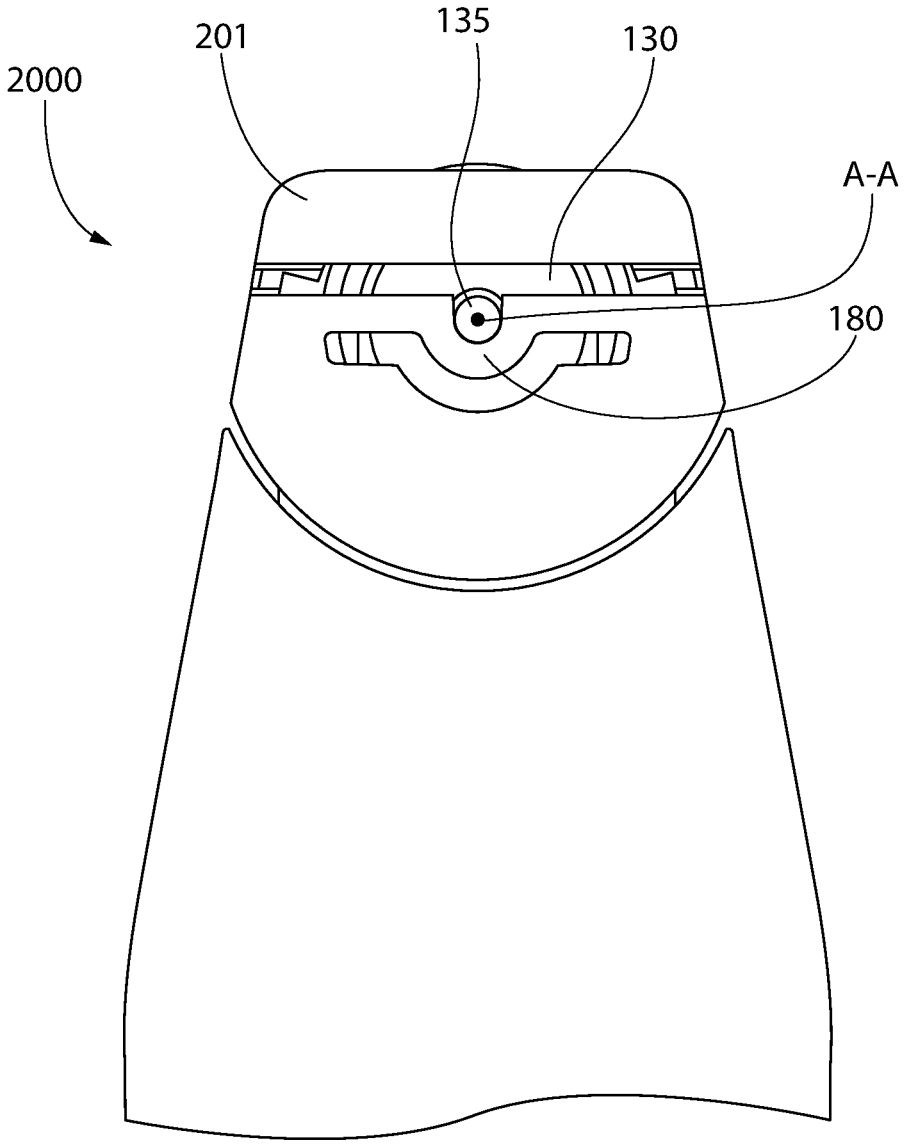
FIG. 12 is a side view of a shaving apparatus in accordance with another embodiment of the present invention illustrating yet another spring member.

Referring to FIG. 12, another embodiment of a shaving apparatus 2000 is illustrated. In this embodiment, the rotary cutter 130 is mounted to the support shaft 135, and the support shaft 135 rests on a spring member 180. Thus, instead of mounting the blade 250 on a spring member as with the previously described embodiment, in this embodiment the rotary cutter 130 is mounted on the spring member 180. FIG. 12 illustrates the spring member 180 in its normal or natural state, such that no forces are being applied onto the spring member 180. However, if a downward force were to be applied onto the rotary cutter 130 (such as may occur due to contact between the blade 250 and the rotary cutter 130 as described above), the spring member 180 will flex downwardly and the restoring spring force of the spring member 180 will press the rotary cutter 130 upwards into contact with the blade 250. Although not shown, in this embodiment the blade 250 is mounted directly to the support member 201 without any intervening spring, making it substantially rigid (although the blade 250 may also be mounted on a spring member as described above in the previous embodiments).

In the exemplified embodiment, the spring member 180 is formed by a pair of bridges formed on either side of the support member 201. This allows the rotational axis A-A of the rotary cutter 130 to move upwardly and downwardly as forces are applied onto the spring member 180 that cause the spring member 180 to adjust between its normal and biased states. By pre-loading the spring member 180, the rotary cutter 130 is biased into contact with the blade 250. A contact force results from this interaction between the rotary cutter 130 and the blade 250. The bridges are free to deflect away from the blade 250, and may be designed to have dimensions which provide a desired spring constant. Various geometries, thicknesses, and widths may be used to adjust the spring constant. It is also envisioned that the spring constant may not be equal on both sides of the support member 201 in some embodiments.

Regardless of the exact configuration and location of the spring members, the spring members may provide a contact force that will maintain the contact between the blade 250 and the rotary cutter 130 to achieve a consistent and effective cutting of whiskers. The magnitude of the contact force may be configurable by changing the properties or the design of the spring member. In some embodiments, the spring member may be designed to apply a force sufficient to maintain contact between the blade 250 and the rotary cutter 130 during the shearing of whiskers. This contact force is intended to be sufficient to maintain contact between the blade 250 and the rotary cutter 130 during the shearing of whiskers such that whiskers or hairs being sheared, or a portion of them, cannot become wedged between the blade 250 and rotary cutter 130. This force is intended to be sufficient to maintain contact between the blade 250 and the rotary cutter 130 during the shearing of whiskers such that the profile of the sheared end of the whiskers or hairs being sheared is approximately flat. The angle of the sheared end of the whiskers may be less than, e.g., 10, 20, 30, or 45 degrees. The height of the sheared end of the whiskers may be less than 1, 2, 3, 4, 5, or 10 times the whisker diameter. The percentage of cut whiskers whose angle of sheared end is larger than 10, 20, 30, or 45 degrees may be less than 5, 10, 20, or 30% in some embodiments. The percentage of cut whiskers whose height of the sheared end is less than 1, 2, 3, 4, 5, or 10 times the whisker diameter may be less than 5, 10, 20, or 30% in some embodiments.

A further advantage of the incorporation of a spring member into the shaving apparatus 1000 is the ability to compensate for tolerances in the manufacture of the various components. Where alignment features are used to locate the blade 250, the tolerances of the alignment features, tolerances in the mounting of the rotary cutter 130, and tolerances in the manufacture of the rotary cutter 130 all contribute to variations in the distance between the blade 250 and the rotary cutter 130. In some of the resulting devices, the blade 250 may not have the required contact force or, in some embodiments, a gap may exist between the blade 250 and the rotary cutter 130. Other devices may suffer from excessive pre-load, resulting in damage to the blade 250, rotary cutter 130, or the motor 110.

Referring to FIGS. 4A-4C, 13, and 15A, the structure of the refill blade assembly 200 that enables it to be detachably coupled to the base portion 100 will be described. The first end wall 211 of the cover member 210 of the refill blade assembly 200 has an outer surface 260 and an inner surface 261. Similarly, the second end wall 212 of the cover member 210 of the refill blade assembly 200 has an outer surface 270 and an inner surfaced 271. In the exemplified embodiment, the refill blade assembly 200 comprises a first coupling element 262 located on the inner surface 261 of the first end wall 211 and a second coupling element 272 located on the inner surface 271 of the second end wall 212. Although first and second coupling elements 262, 272 are illustrated in the exemplified embodiment, in some embodiments the refill blade assembly 200 may comprise one or more coupling elements, such as only including one of the first and second coupling elements 262, 272, but not both. As noted above, due to the movement of the spring member 230, the blade 250 is alterable between a normal state in which the cutting edge 251 of the blade 250 is at a first position relative to the first and second coupling elements 262, 272 and a biased state in which the cutting edge 251 of the blade 250 is at a second position relative to the first and second coupling elements 262, 272, the first and second positions being different from one another.

In the exemplified embodiment, the first coupling element 262 comprises a first protuberance 264 extending from the inner surface 261 of the first end wall 211 and protruding into the cavity 216 of the cover member 210. The first protuberance 264 has a first concave surface 263. Specifically, the first concave surface 263 is a contoured top surface of the first protuberance 264. Furthermore, the second coupling element 272 comprises a second protuberance 274 extending from the inner surface 271 of the second end wall 212 and protruding into the cavity 216 of the cover member 210. The second protuberance 274 has a second concave surface 273. More specifically, the second concave surface 273 is a contoured top surface of the second protuberance 274.

The support shaft 135 that supports the rotary cutter 130 has a first end portion 136 and a second end portion 137. A bottom portion of each of the first and second end portions 136, 137 of the support shaft 135 is exposed and acts as a coupling element of the base portion 100 of the shaving apparatus 1000. The coupling elements 262, 272 of the refill blade assembly 200 engage the exposed bottom portions of the first and second end portions 136, 137 of the support shaft 135 to couple the refill blade assembly 200 to the base portion 100, as described below.

Figure 13:
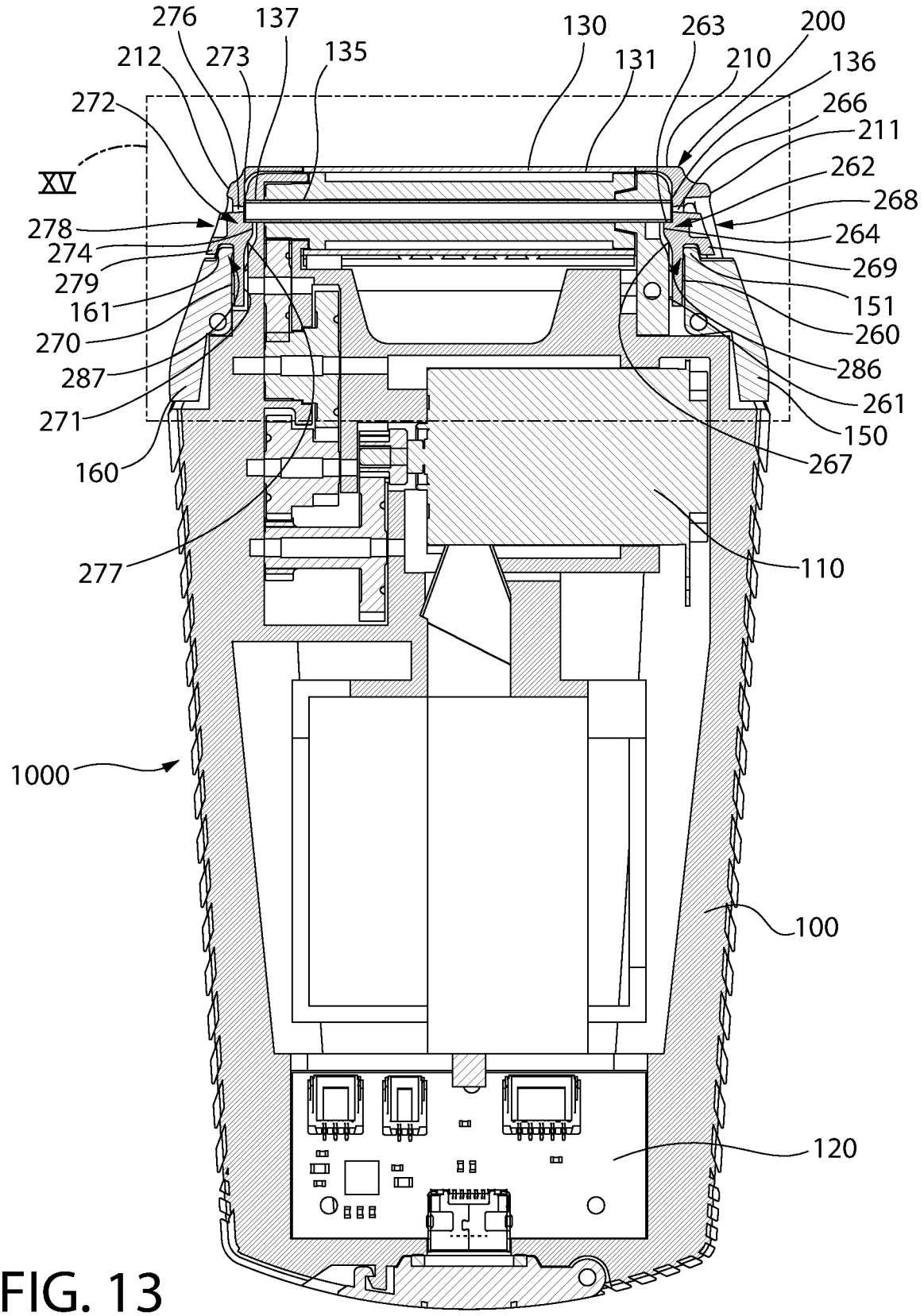
FIG. 13 is a cross-sectional view taken along line XIII-XIII in FIG. 5.
Figure 15A:
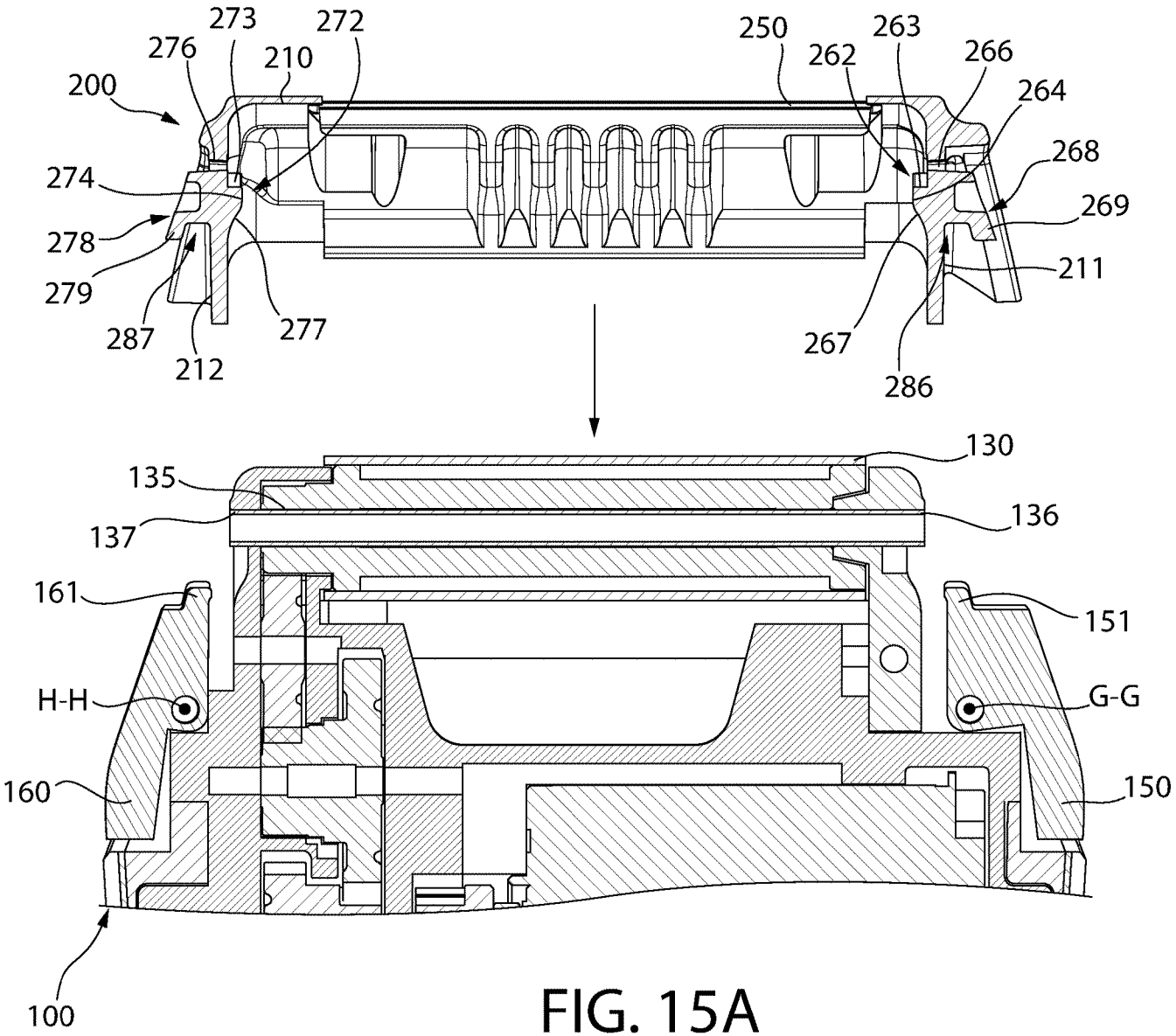
FIGS. 15A-15F are close-up views of area XV of FIG. 13 illustrating the refill blade assembly moving from a detached state relative to the base portion of the shaving apparatus to an attached state and then back again to a detached state.

Specifically, when the refill blade assembly 200 is coupled to the base portion 100 of the shaving apparatus 1000, the first concave surface 263 engages the first end portion 136 of the support shaft 135 and the second concave surface 273 engages the second end portion 137 of the support shaft 135. The engagement between the first and second concave surfaces 263, 273 and the first and second ends 136, 137 of the support shaft 135 couples the refill blade assembly 200 to the base portion 100 of the shaving apparatus 1000, as best illustrated in FIGS. 13 and 15D.

The first protuberance 264 is formed on a flexible portion 265 of the first end wall 211. Specifically, the first end wall 211 comprises a U-shaped cutout 266 that partially surrounds the flexible portion 265 of the first end wall 211. The U-shaped cutout 266 extends through the thickness of the first end wall 211 from the outer surface 260 to the inner surface 261. This permits the flexible portion 265 of the first end wall 211 to flex relative to the remainder of the first end wall 211. As noted above, the first protuberance 264 is formed on the flexible portion 265 of the first end wall 211. The top surface of the first protuberance 264 forms the first concave surface 264 as noted above and the bottom surface of the first protuberance 264 forms a chamfered surface 267.

The second protuberance 274 is formed on a flexible portion 275 of the second end wall 212. Specifically, the second end wall 212 comprises a U-shaped cutout 276 that partially surrounds the flexible portion 275 of the second end wall 212. The U-shaped cutout 276 extends through the thickness of the second end wall 212 from the outer surface 270 to the inner surface 271. This permits the flexible portion 275 of the second end wall 212 to flex relative to the remainder of the second end wall 212. As noted above, the second protuberance 274 is formed on the flexible portion 275 of the second end wall 212. The top surface of the second protuberance 274 forms the second concave surface 274 as noted above and the bottom surface of the second protuberance 274 forms a chamfered surface 277. The chamfered surfaces 267, 277 along with the flexibility of the flexible portions 265, 275 of the first and second protuberances 264, 274 facilitate the attachment of the refill blade assembly 200 to the base portion 100 as discussed in greater detail below with reference to FIGS. 15A-15D.

Furthermore, the refill blade assembly 200 comprises a first tab element 268 extending from the outer surface 260 of the first end wall 211 and a second tab element 278 extending from the outer surface 270 of the second end wall 212. The first tab element 268 comprises a portion 269 that is spaced from the outer surface 260 of the first end wall 211, thereby forming a first nesting cavity 286 between the outer surface 260 of the first end wall 211 and the portion 269 of the first tab element 268. The second tab element 278 comprises a portion 279 that is spaced from the outer surface 270 of the second end wall 212, thereby forming a second nesting cavity 287 between the outer surface 270 of the second end wall 212 and the portion 279 of the second tab element 278.

Referring briefly to FIGS. 3 and 13, the base portion 100 of the shaving apparatus 1000 comprises a first actuator 150 on a first side thereof and a second actuator 160 on a second side thereof. Of course, in some embodiments the base portion 100 may include only one of the first and second actuators 150, 160, but not both. The first actuator 150 comprises a first protrusion 151 at its upper end and the second actuator 160 comprises a second protrusion 161 at its upper end. When the refill blade assembly 200 is coupled to the base portion 100, the first protrusion 151 of the first actuator 150 nests within the first nesting cavity 286 and the second protrusion 161 of the second actuator 160 nests within the second nesting cavity 286. This allows the first and second actuators 150, 160 to force the flexible portions 265, 275 of the first and second end walls 211, 212 to flex to permit detachment of the refill blade assembly 200 from the base portion 100 when such is desired.

As will be discussed below with reference to FIGS. 16D-16F, the first and second actuators 150, 160 are rockers that are configured to rotate or pivot about a pivot axis. Specifically, the first actuator 150 is configured to pivot about a pivot axis G-G and the second actuator 160 is configured to pivot about a pivot axis H-H (FIG. 15A). When fully assembled, the first protrusion 151 engages the portion 269 of the first tab element 268 and the second protrusion 161 engages the portion 279 of the second tab element 278. Thus, as discussed below, rocking or pivoting the first and second actuators 150, 160 causes the actuators 150, 160 to flex the flexible portions 165, 175 of the first and second end walls 211, 212 to disengage the coupling elements of the refill blade assembly 200 from the first and second ends 136, 137 of the support shaft 135 to detach the refill blade assembly 200 from the base portion 100.

Figure 14A:
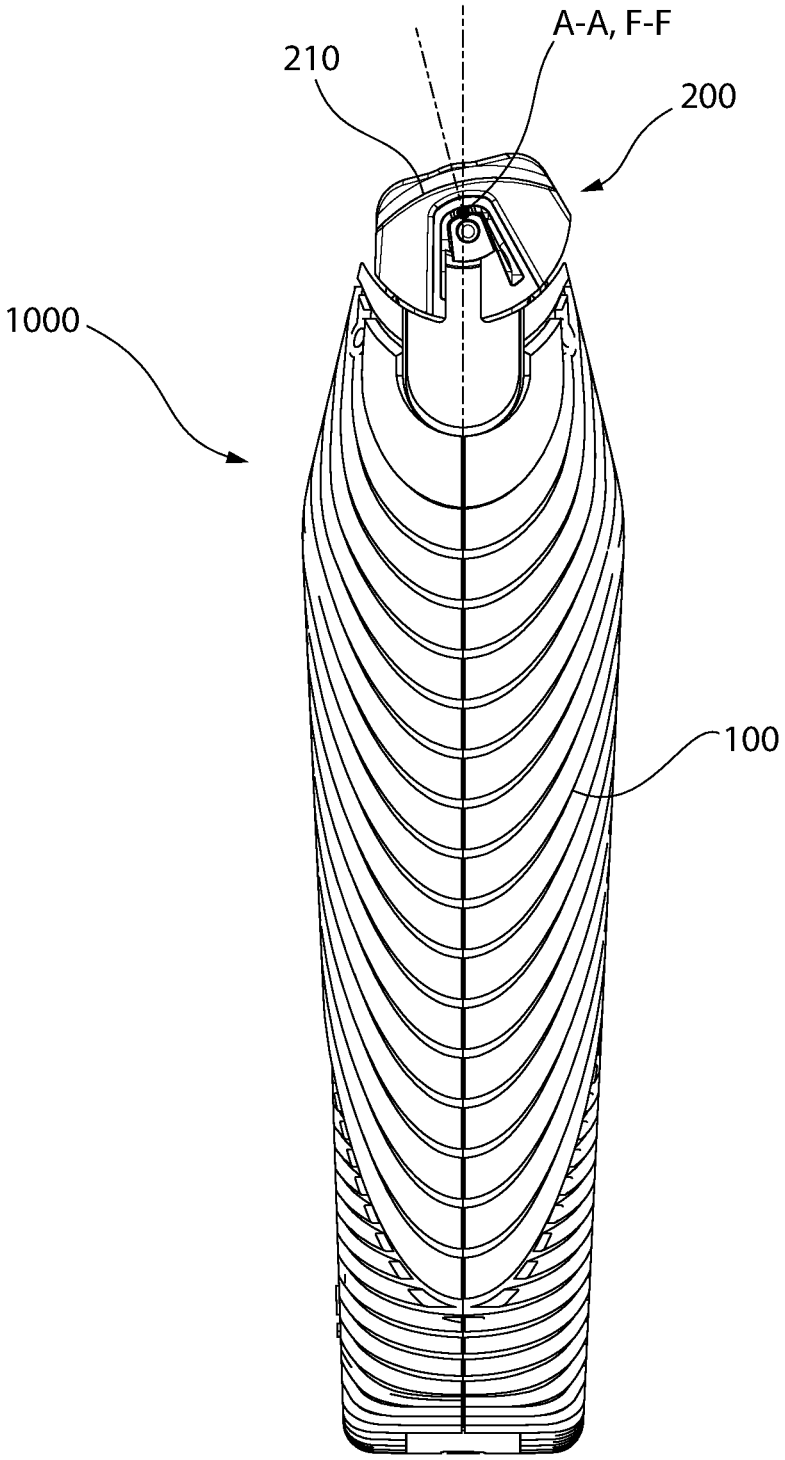
FIG. 14A is a side view of the shaving apparatus of FIG. 1 illustrating the refill blade assembly pivoted in a first direction.
Figure 14B:
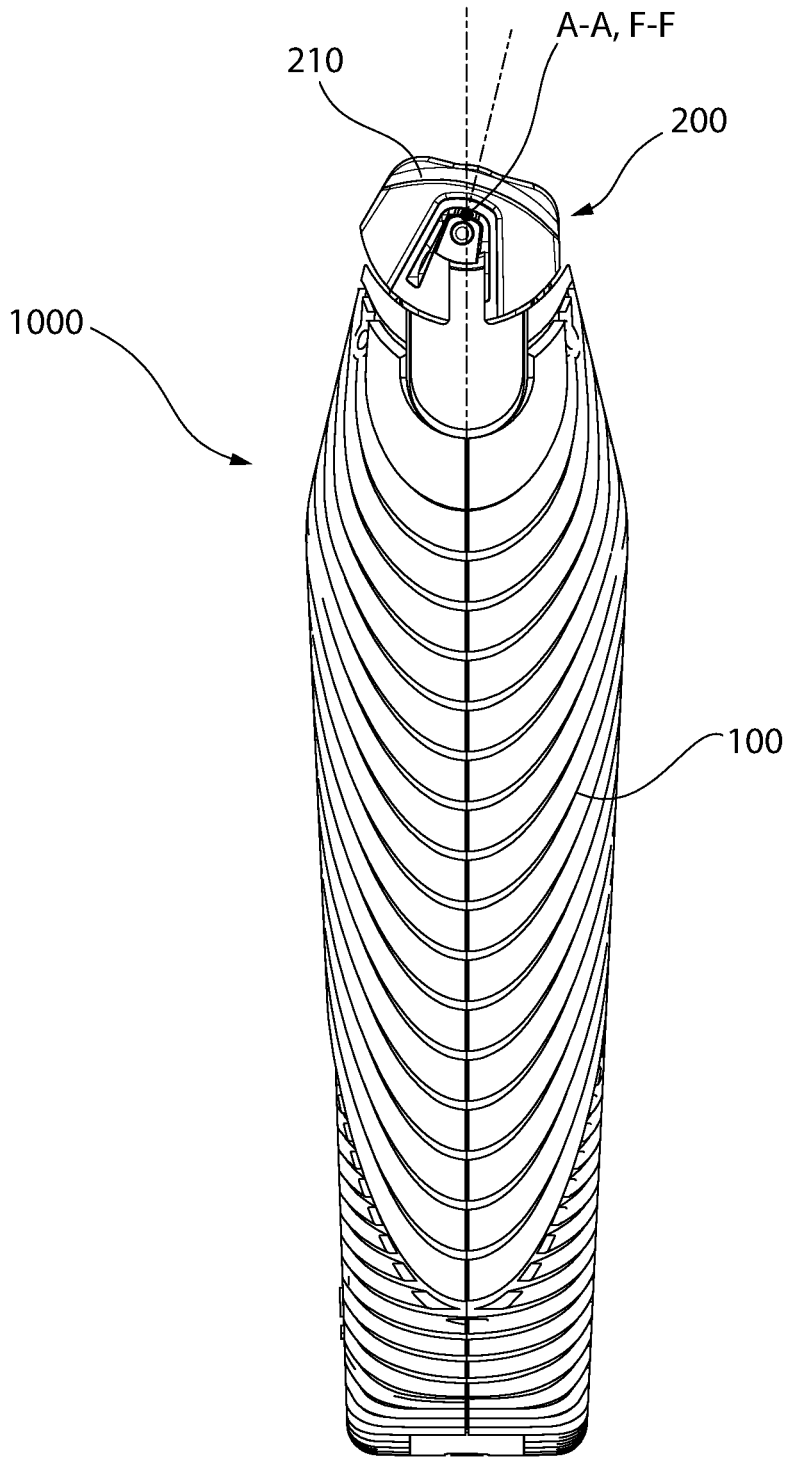
FIG. 14B is a side view of the shaving apparatus of FIG. 1 illustrating the refill blade assembly pivoted in a second direction.

Referring to FIGS. 13, 14A, and 14B concurrently, when the refill blade assembly 200 is coupled to the base portion 100 of the shaving apparatus 1000, the cover member 210 is pivotable relative to the base portion 100 about a pivot axis F-F that is coincident with the rotational axis A-A of the rotary cutter 130. In the exemplified embodiment, the pivot axis F-F and the rotational axis A-A are the same axis. Specifically, the first and second concave surfaces 263, 273 of the coupling elements have a shape that matches the shape of the first and second end portions 136, 137 of the support shaft 135, thereby permitting pivotable rotation of the cover member 210 of the refill blade assembly 200 relative to the base portion 100. Because the outer surfaces of the first and second end portions 136, 137 of the support shaft 135 and the first and second concave surfaces 263, 273 are rounded or arcuate surfaces, the refill blade assembly 200 is configured to pivot when coupled to the base portion 100. The refill blade assembly 200 is pivotable about the pivot axis F-F between the positions illustrated in FIG. 14A and FIG. 14B. Thus, the refill blade assembly 200 is coupled to the base portion 100 so as to be pivotable about the pivot axis F-F about a delimited angle of rotation. In certain embodiments, the full angle of rotation is in a range of 15°-40°, more specifically 20°-35°, and still more specifically 25°-30°. The full angle of rotation is the angle of rotation when rotating between the position illustrated in FIG. 14A to the position illustrated in FIG. 14B.

The refill blade assembly 200 is infinitely adjustable within the delimited angle of rotation such that it can be pivoted to any position between the delimited positions illustrated in FIGS. 14A and 14B. Furthermore, the refill blade assembly 200 is freely adjustable within the delimited angle of rotation such that it does not become locked into any position. Thus, the position of the refill blade assembly will change dynamically during shaving, thus enabling the shaving apparatus 100 to be better able to adjust to different facial and other skin surface contours.

Furthermore, it should be appreciated that due to the spring member 230 described herein above, the blade 250 remains biased into contact with the rotary cutter 130 during pivoting of the refill blade assembly 200 relative to the base portion 100 and the rotary cutter 130. Thus, regardless of whether the refill blade assembly 200 is positioned relative to the base portion 100 as shown in FIG. 14A, as shown in FIG. 14B, or at any position therebetween, the blade 250 remains biased into direct surface contact with the rotary cutter 130 by the spring member 230, preferably along the entire length of the cutting edge 251 of the blade 250.

Figure 15B:
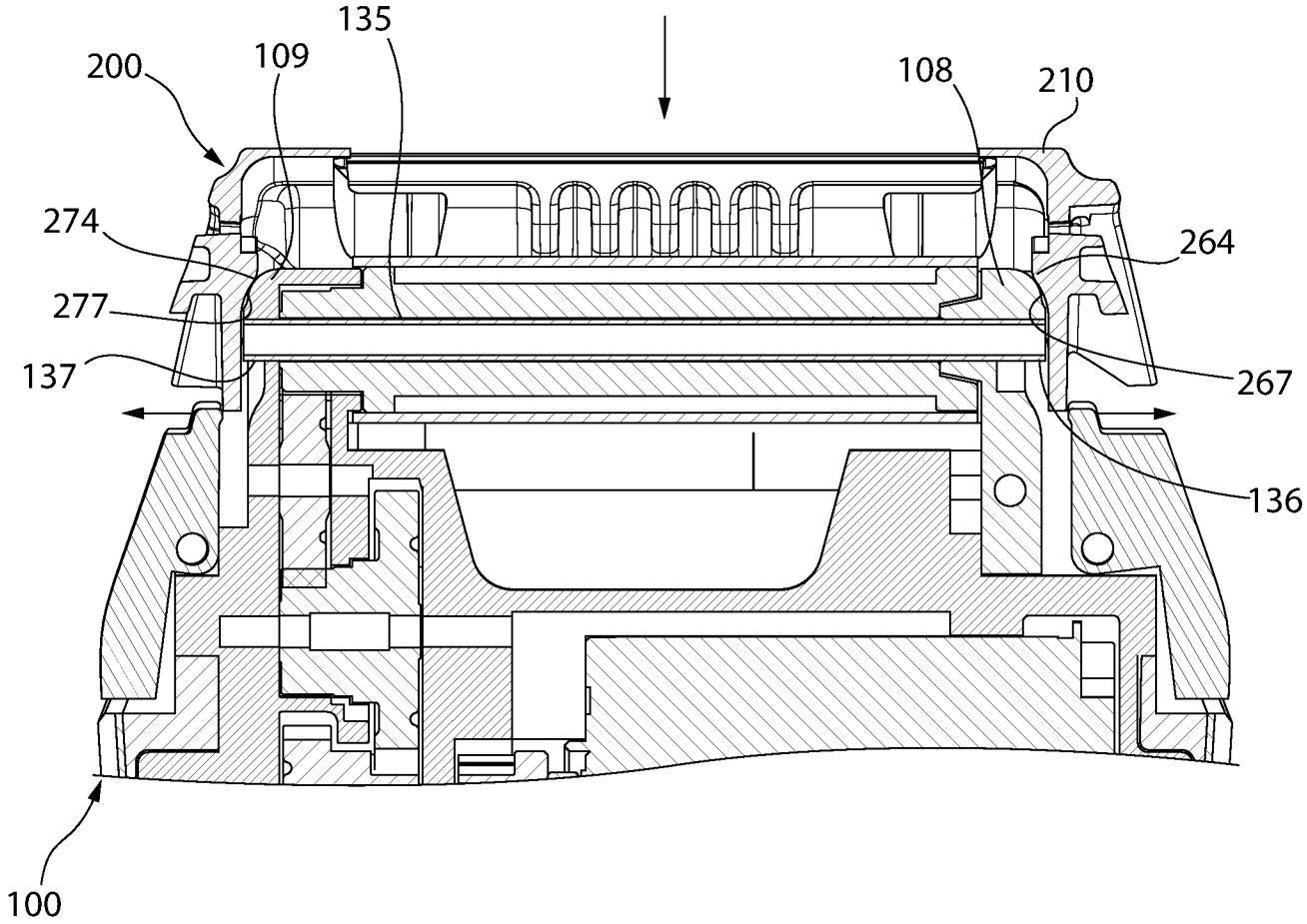
Figure 15C:
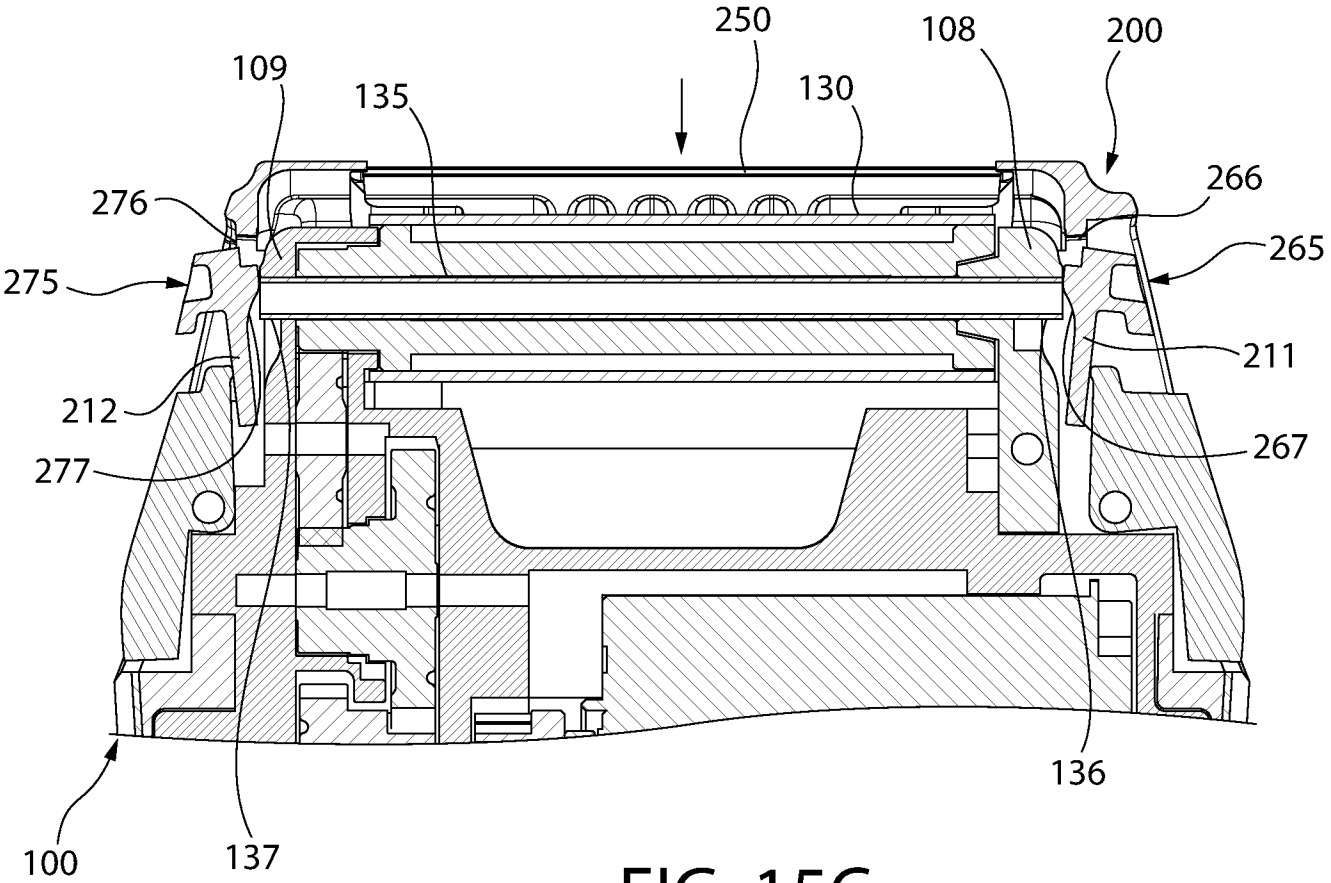
Figure 15D:
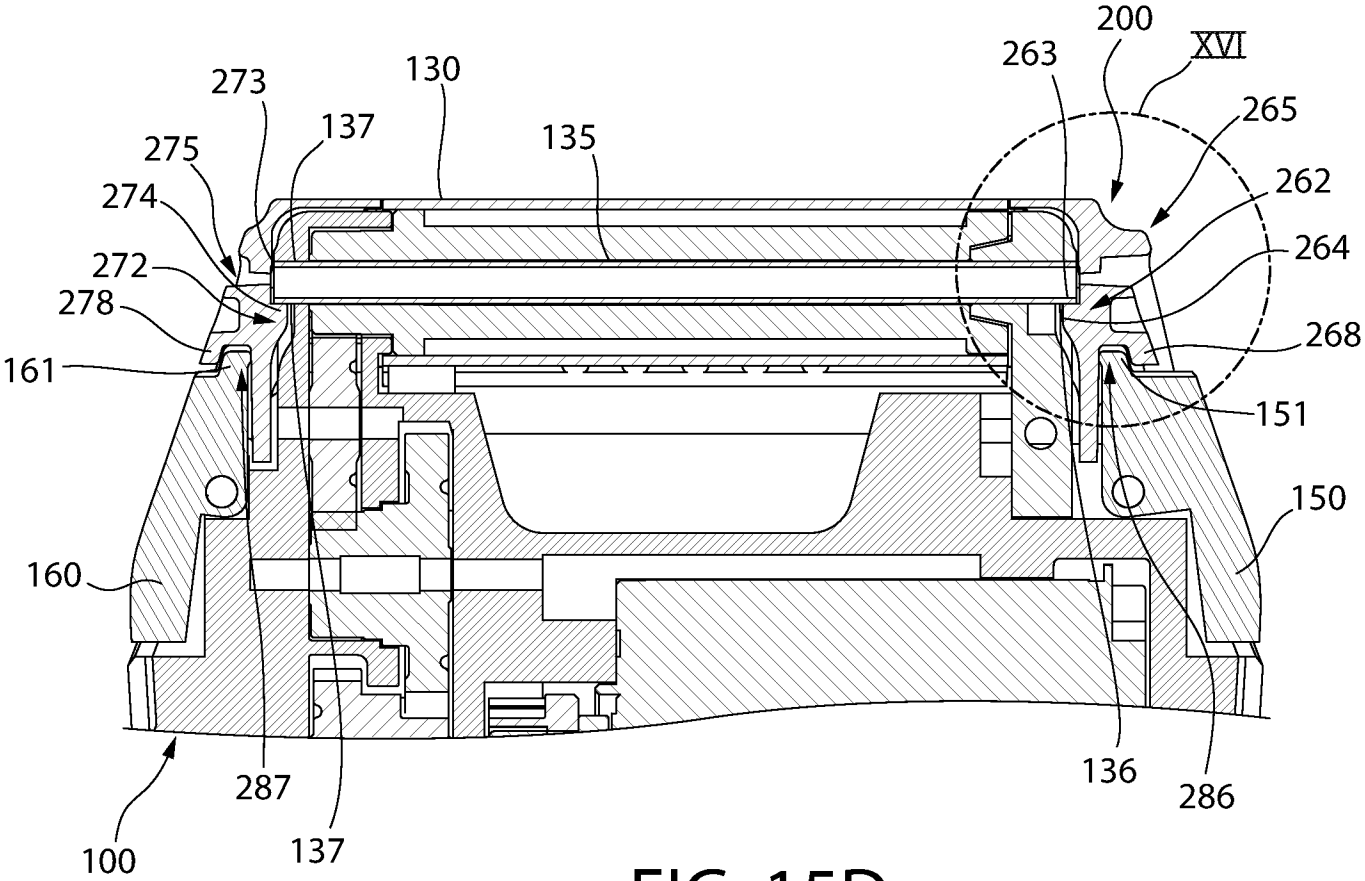

Referring to FIGS. 15A-15F, the manner of coupling the refill blade assembly 200 to the base portion 100 will be described. First, FIG. 15A illustrates the refill blade assembly 200 positioned in preparation for its coupling to the base portion 100. In FIG. 15B, the refill head assembly 200 has been moved downwardly towards the base portion 100 until the point of first contact between the refill head assembly 200 and the base portion 100. Specifically, the refill head assembly 200 is moved downwardly towards the base portion 100 until the chamfered surfaces 267, 277 of the first and second protuberances 264, 274 contact a portion of the base portion 100 of the shaving apparatus 1000. As shown in FIG. 15B, the chamfered surfaces 267, 277 of the first and second protuberances 264, 274 contact the mounting arms 108, 109 of the base portion 100 as the refill blade assembly 200 is brought downwardly towards the base portion 100.

As shown in FIG. 15C, as the refill blade assembly 200 is continued to be moved downwardly towards the base portion 100 for coupling the refill blade assembly 200 to the base portion 100, the flexible portions 265, 275 of the first and second end walls 211, 212 flex outwardly relative to the remainder of the first and second end walls 211, 212 as the chamfered surfaces 267, 277 ride along the mounting arms 108, 109 of the base portion 100.

As shown in FIG. 15D, the refill blade assembly 200 continues to be moved downwardly towards the base portion 100 until the first concave surface 263 of the first protuberance 264 engages the first end portion 136 of the support shaft 135 and the second concave surface 273 of the second protuberance 274 engages the second end portion 137 of the support shaft 135. Specifically, once the protuberances 264, 274 pass completely over the support shaft 135, the flexible portions 265, 275 are biased back inwardly into their natural state, as shown in FIG. 15D. The engagement of the first concave surface 263 that forms the upper surface of the first protuberance 264 with the first end portion 136 of the support shaft 135 and the second concave surface 273 that forms the upper surface of the second protuberance 274 with the second end portion 137 of the support shaft 135 prevents the refill blade assembly 200 from being readily detached from the base portion 100. Specifically, in FIG. 15D the first and second coupling elements 262, 272 are in a locked state in which the coupling elements 262, 272 engage the support shaft 135 and prevent the refill blade assembly 200 from being removed from the base portion 100.

Although in the exemplified embodiment the coupling elements 262, 272 engage the support shaft 135 to complete the coupling of the refill blade assembly 200 to the base portion 100, the invention is not to be so limited in all embodiments. In other embodiments, the coupling elements 262, 272 may engage other structural features on the base portion 100 to lock the refill blade assembly 200 on the base portion 100. Furthermore, although the coupling elements 262, 272 have a very specific structure in the exemplified embodiment, the coupling elements 262, 272 may have other structures and shapes, some example of which are discussed below with reference to the non-limiting embodiments of FIGS. 16A and 16B.

As noted herein, in the exemplified embodiment the engagement of the first and second concave surfaces 263, 273 of the first and second coupling elements 262, 272 with the support shaft 135 secures the refill blade assembly 200 to the base portion 100. Furthermore, because this is the feature that couples the refill blade assembly 200 to the base portion 100, it also enables the pivoting of the refill blade assembly 200 as discussed above with reference to FIGS. 14A and 14B. Specifically, the radius of curvature of the first and second concave surfaces 263, 273 of the first and second coupling elements 262, 272 is substantially the same as the radius of curvature of the outer surface of the support shaft 135. This enables the refill blade assembly 200 to freely pivot about the pivot axis F-F relative to the base portion 100 (within the delimited range of movement). The degree of pivoting of the refill blade assembly 200 relative to the base portion 100 is delimited by portions of the refill blade assembly 200 contacting portions of the base portion 100 when the refill blade assembly 200 is pivoted a certain amount relative to the base portion 100. FIGS. 14A and 14B illustrate the maximum pivot positions of the refill blade assembly 200 relative to the base portion 100 in accordance with an exemplified embodiment. It should be appreciated that in other embodiments a greater pivot angle or a lesser pivot angle than that which is shown may be provided.

Still referring to FIG. 15D, when the refill blade assembly 200 is fully attached to the base portion 100, the first protrusion 151 of the first actuator or rocker 150 nests within the first nesting cavity 186 formed by the first tab element 268. Similarly, the second protrusion 161 of the second actuator or rocker 160 nests within the second nesting cavity 287 formed by the second tab element 278. As a result, the actuators or rockers 150, 160 can be actuated and made to pivot about their respective pivot axes G-G, H-H to detach the refill blade assembly 100 from the base portion 100.

Figure 15E:
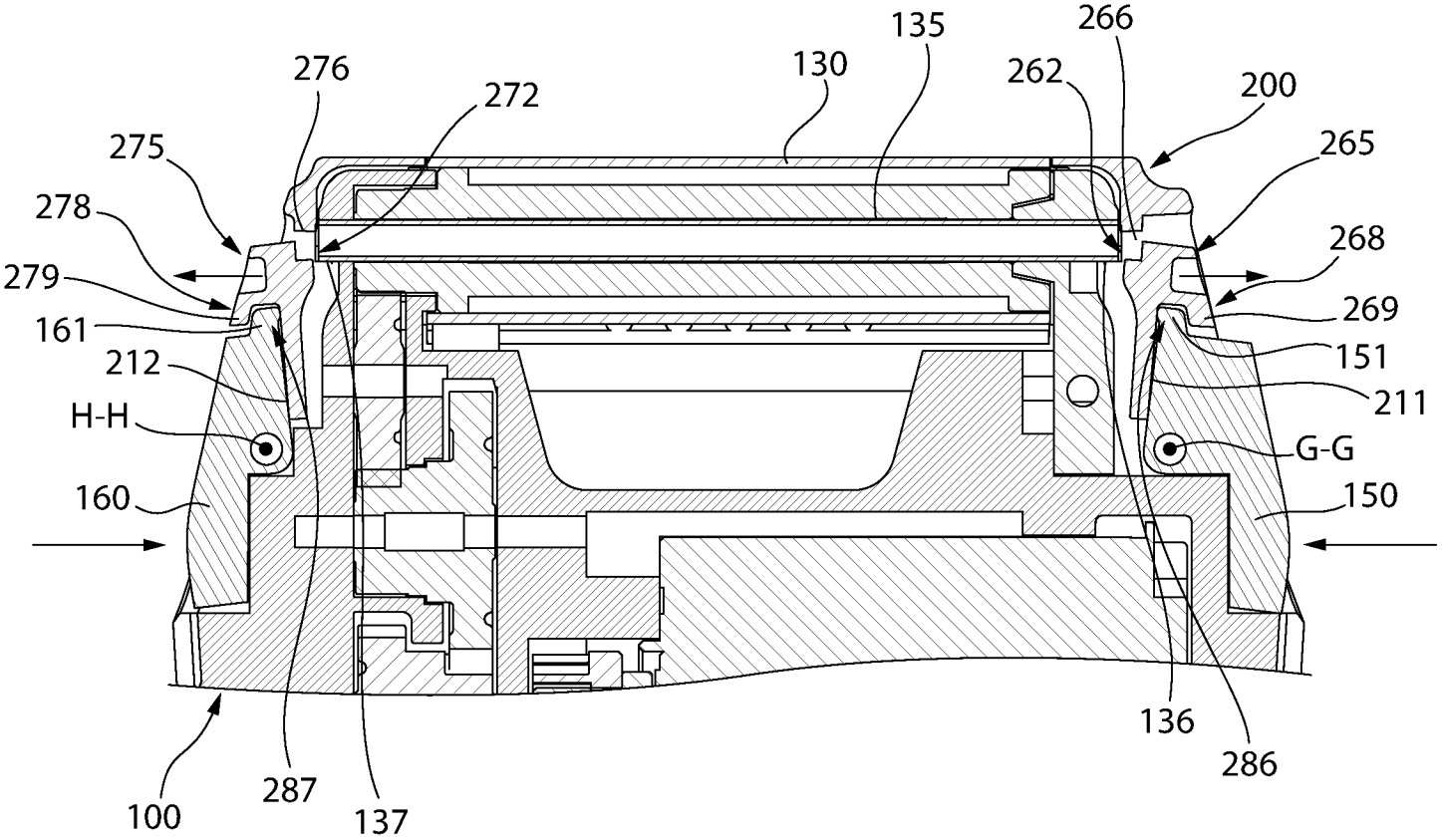

Specifically, referring to FIG. 15E, a force is applied to bottom portions of the first and second actuators 150, 160, thereby causing the first and second actuators 150, 160 to pivot about their respective pivot axes G-G, H-H. As noted above, the first protrusion 151 of the first actuator 150 is located within the nesting cavity 286 and trapped between the portion 269 of the first tab element 268 and the outer surface of the first end wall 211. Thus, as the first actuator 150 pivots about the pivot axis G-G, the first protrusion 151 engages the portion 269 of the first tab element 268 and causes the flexible portion 265 of the first end wall 211 to flex outwardly. This flexing of the flexible portion 265 of the first end wall 211 disengages the first coupling element 262 from the first end portion 136 of the support shaft 135.

Similarly, the second protrusion 161 of the second actuator 160 is located within the nesting cavity 287 and trapped between the portion 279 of the second tab element 278 and the outer surface of the second end wall 212. Thus, as the second actuator 160 pivots about the pivot axis H-H, the second protrusion 161 engages the portion 279 of the second tab element 278 and causes the flexible portion 275 of the second end wall 212 to flex outwardly. This flexing of the flexible portion 275 of the second end wall 212 disengages the second coupling element 272 from the second end portion 137 of the support shaft 135. Once the first and second actuators 150, 160 are actuated, the first and second coupling elements 262, 272 are in an unlocked state because they disengage from the support shaft 135 or other structure to which they are engaged when in the locked state.

Figure 15F:
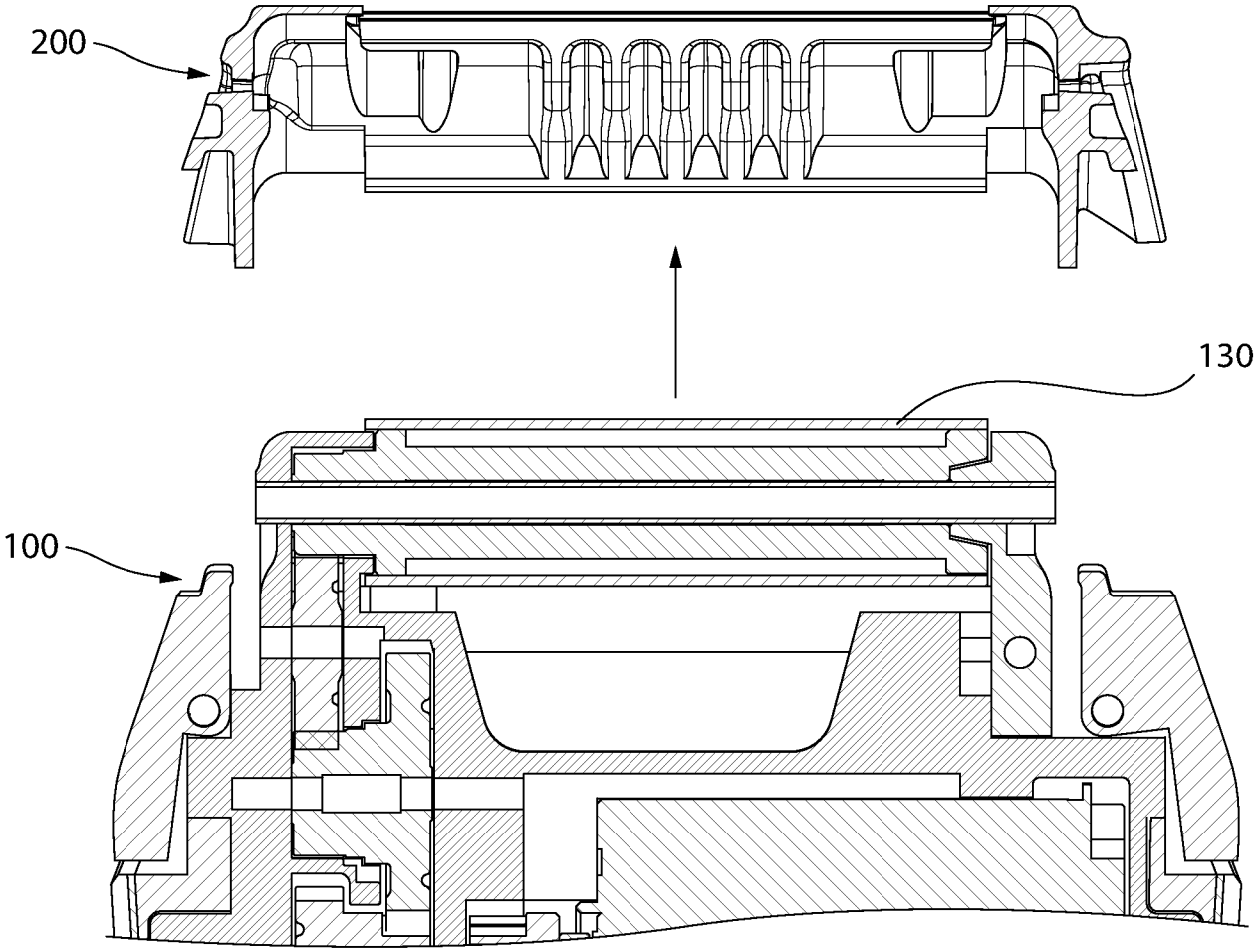

Thus, at this point there is nothing preventing the refill blade assembly 200 from being detached from the base portion 100. Referring to FIG. 15F, once the actuators 150, 160 are actuated as described above, a user can pull the refill blade assembly 200 away from the base portion 100 to detach the refill blade assembly 200 from the base portion 100.

Figure 16A:
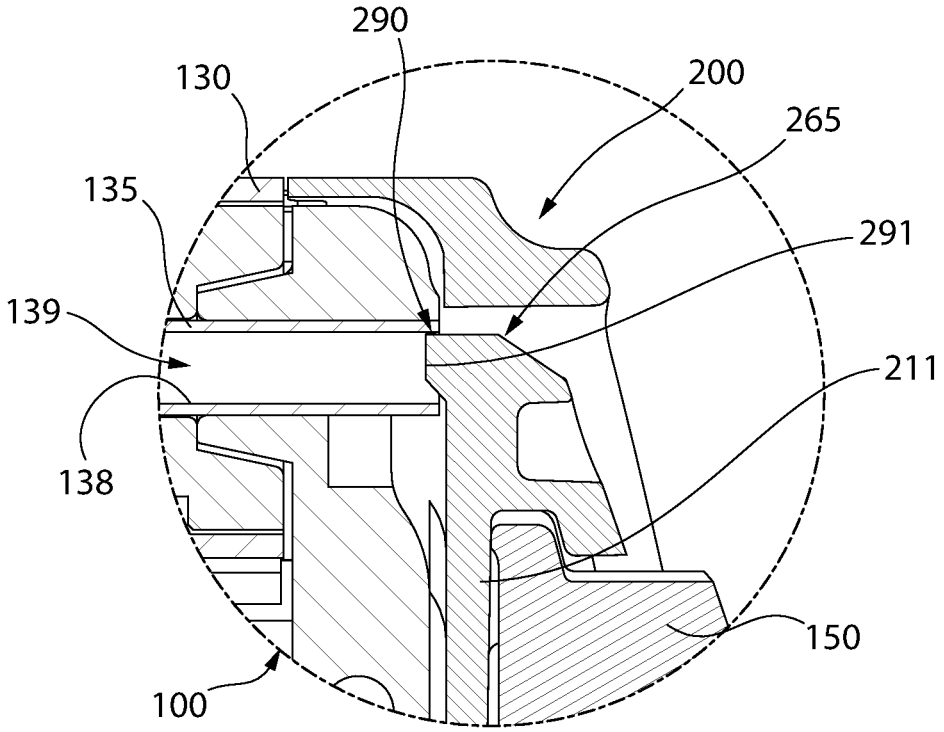
FIG. 16A is a close-up view of area XVI of FIG. 15D in accordance with a first alternative embodiment.
Figure 16B:
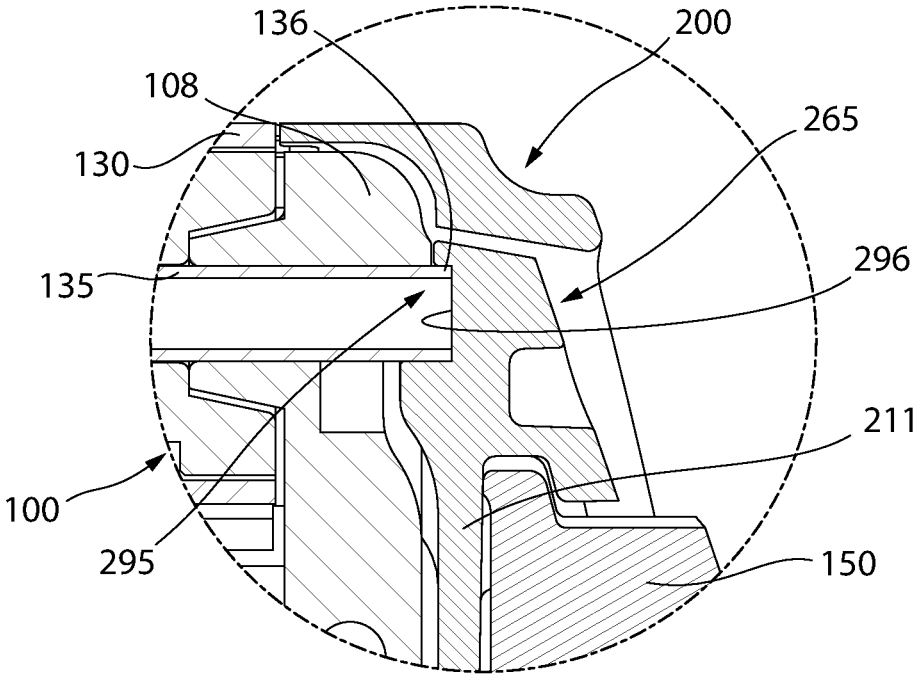
FIG. 16B is a close-up view of area XVI of FIG. 15D in accordance with a second alternative embodiment.

Referring to FIGS. 16A and 16B, alternative structural arrangements for the coupling elements on the refill blade assembly 200 are illustrated. FIGS. 16A and 16B only illustrate one of the coupling elements, but it should be appreciated that the opposite side of the refill blade assembly 200 may have an identical coupling element as has been shown and described with the main embodiment described above. Specifically, in FIGS. 16A and 16B only the first end wall 211 of the refill blade assembly 200 is illustrated, but an identical coupling element may also be provided on the second end wall 212.

In FIG. 16A, the refill blade assembly 200 comprises one or more coupling elements 290 comprising a boss 291 extending from the inner surface of the first end wall 211. The boss 291 may have a curved upper surface and a chamfered lower surface. Thus, as the refill blade assembly 200 is being coupled to the base portion 100, the chamfered surface of the boss 291 will ride along portions of the base portion 100 and cause the flexible portion 265 of the first end wall 211 to flex outwardly similar to that which was described above. In this embodiment, the support shaft 135 has an inner surface 138 that defines or bounds a passageway 139. Thus, in this embodiment as soon as the boss 291 is aligned with the passageway 139 of the support shaft 135, the flexible portion 265 of the first end wall 211 will bias back into its natural state and the boss 291 of the coupling element 290 will extend into passageway 139. Thus, the engagement between the upper surface of the boss 291 and the inner surface 138 of the support shaft 135 is what locks the refill blade assembly 200 onto the base portion 100. The refill blade assembly 200 in such embodiment will still be capable of pivoting when in the attached state just as described with reference to FIGS. 14A and 14B. Furthermore, detaching the refill blade assembly 200 from the base portion 100 is achieved using the actuators 150, 160 in much the same way as has been described above.

FIG. 16B illustrates still another embodiment of the coupling element 265 of the refill blade assembly 200. In this embodiment, the first end portion 136 of the support shaft 135 protrudes out from the mounting arm 108 that supports it. Furthermore, the refill blade assembly 200 comprises a coupling element 295 formed into the inner surface of the first end wall 211. In this embodiment, the coupling element 295 comprises a recess 296 that receives the portion of the first end portion 136 of the support shaft 135 that protrudes out from the mounting arm 108. Thus, as the refill blade assembly 200 is being attached to the base portion 100, the flexible portion 265 of the first end wall 211 will flex outwardly as the chamfered surface rides along the base portion 100 and the first end portion 136 of the support shaft 135. Then, as soon as the first portion 136 of the support shaft 135 is aligned with the recess 296, the flexible portion 265 of the first end wall 211 will bias back into its normal or natural state, and the first portion 136 of the support shaft 135 will enter into the recess 296. Thus, as can be seen in FIG. 16B, the engagement between the first portion 136 of the support shaft 135 and the recess 296 of the coupling element 295 prevents the refill blade assembly 200 from being readily detached from the base portion 100. However, actuation of the actuator 150 will enable the refill blade assembly 200 to be detached from the base portion 100 in the same manner as described herein above with reference to FIGS. 15E and 15F.

Of course, additional alternative embodiments and structures for the coupling elements are possible in other embodiments. It is merely desirable that the coupling elements of the refill blade assembly 200 engage one or more structures on the base portion 100 to lock the refill blade assembly 200 to the base portion 100 such that the coupling elements are alterable between a locked state in which the one or more coupling elements engage one or more structures, thereby preventing the refill blade assembly 200 from being removed from the base portion 100 and an unlocked state in which the one or more coupling elements disengage the one or more structures, thereby allowing the refill blade assembly 200 to be removed from the base portion 100. In the exemplified embodiment, the first and second actuators 150, 160 (which may in certain embodiments merely be one or more actuators without requiring both the first and second actuators) are configured to alternate the one or more coupling elements from the locked state to the unlocked state.

Referring to FIGS. 17-19A, the shaving apparatus 1000 is illustrated being supported by a cartridge 600 having a plurality of slots 601. The cartridge 600 is designed to protect the blade refill assembly 200 during storage, transit, handling, and between shaves. In some embodiments, the cartridge 600 may be used for attaching the blade refill assembly 200 to and detaching the blade refill assembly 200 from the base portion 100 of the shaving apparatus 1000. The cartridge 600 may be designed and configured to remove a refill blade assembly 200 from the base portion 100 and to load a new refill blade assembly 200 to the base portion 100 within a single one of the slots 601. In the exemplified embodiment, the cartridge 600 is a unitary component that has no moving parts and requires no assembly. The cartridge 600 may include flexible subsections and be composed of transparent, partially transparent, translucent, and/or opaque materials.

As with the previously described embodiments, the rotary cutter 130 is supported by a support shaft 135 around which the rotary cutter 130 rotates. Furthermore, in this embodiment on both opposing sides of the support shaft 135 there is a spring pin 140. In some embodiments, the spring pin 140 may be a single spring pin that is inserted within a passageway of the support shaft 135 and that is longer than the support shaft 135 so that it protrudes from the opposing ends of the support shaft 135. In other embodiments there may be multiple spring pins 140 coupled to the support shaft 135 on opposing ends of the support shaft 135. Either way, each of the spring pins 140 (or the singular spring pin) extends through openings 141 in the refill blade assembly 200 located on opposing sides of the refill blade assembly. The spring pins 141, due to their extension through the opening 141 in the refill blade assembly 200, function to secure the refill blade assembly 200 to the base portion 100 of the shaving apparatus 1000. In order to detach the refill blade assembly 200 from the base portion 100, the spring pins 140 must be biased against their spring force and pushed in through the openings 141 in the refill blade assembly 200. In the exemplified embodiment, detaching the refill blade assembly 200 from the base portion 100 is achieved entirely by the cartridge 600 along with some user interaction to move the shaving apparatus 1000 along one of the slots 601 of the cartridge 600.

Each of the slots 601 of the cartridge 600 comprises two opposing upstanding walls 602, 603 and a flange 604, 605 extending from a top of the upstanding walls 602, 603. The refill blade assembly 200 can be detached from the base portion 100 of the shaving apparatus 1000 by sliding the shaving apparatus 1000 into one of the slots 601 along the axis I-I illustrated in FIG. 18 until the shaving apparatus 1000 abuts against a bottom wall 606 of the slot 601.

Figure 17:
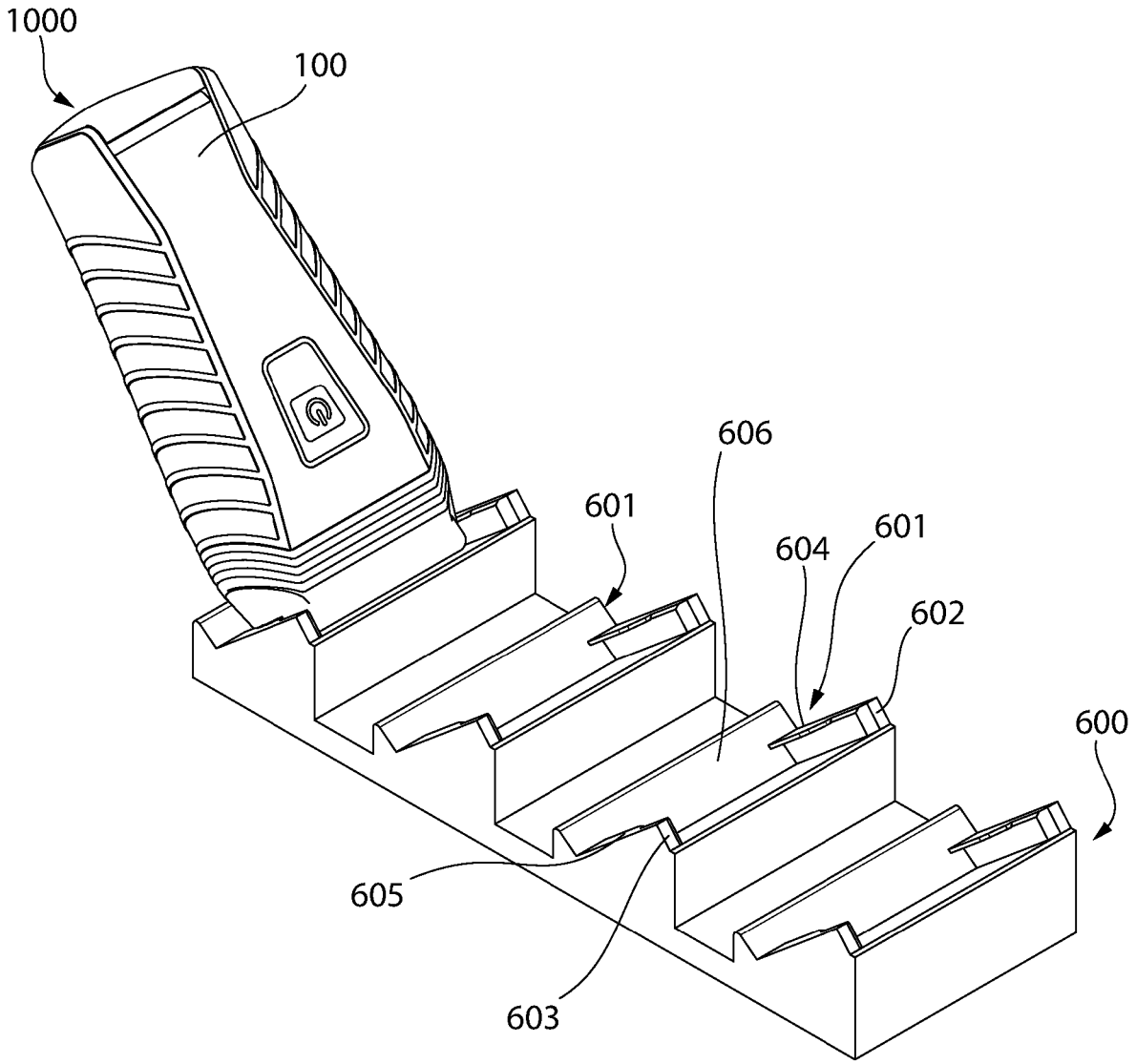
FIG. 17 is a perspective view of the shaving apparatus of FIG. 1 positioned within a refill blade assembly cartridge.
Figure 18:
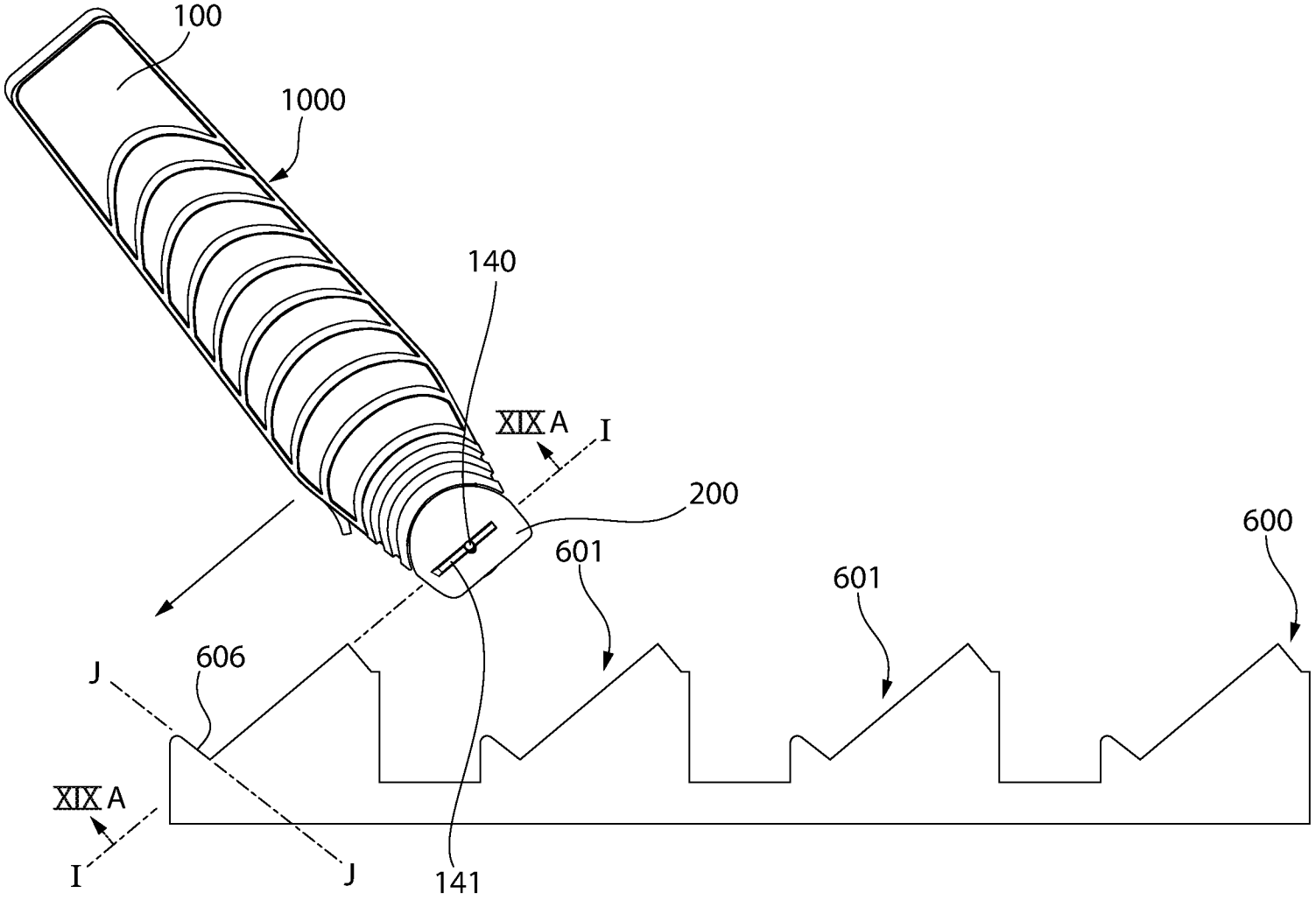
FIG. 18 is a side view of the shaving apparatus and refill blade assembly cartridge of FIG. 17.
Figure 19A:
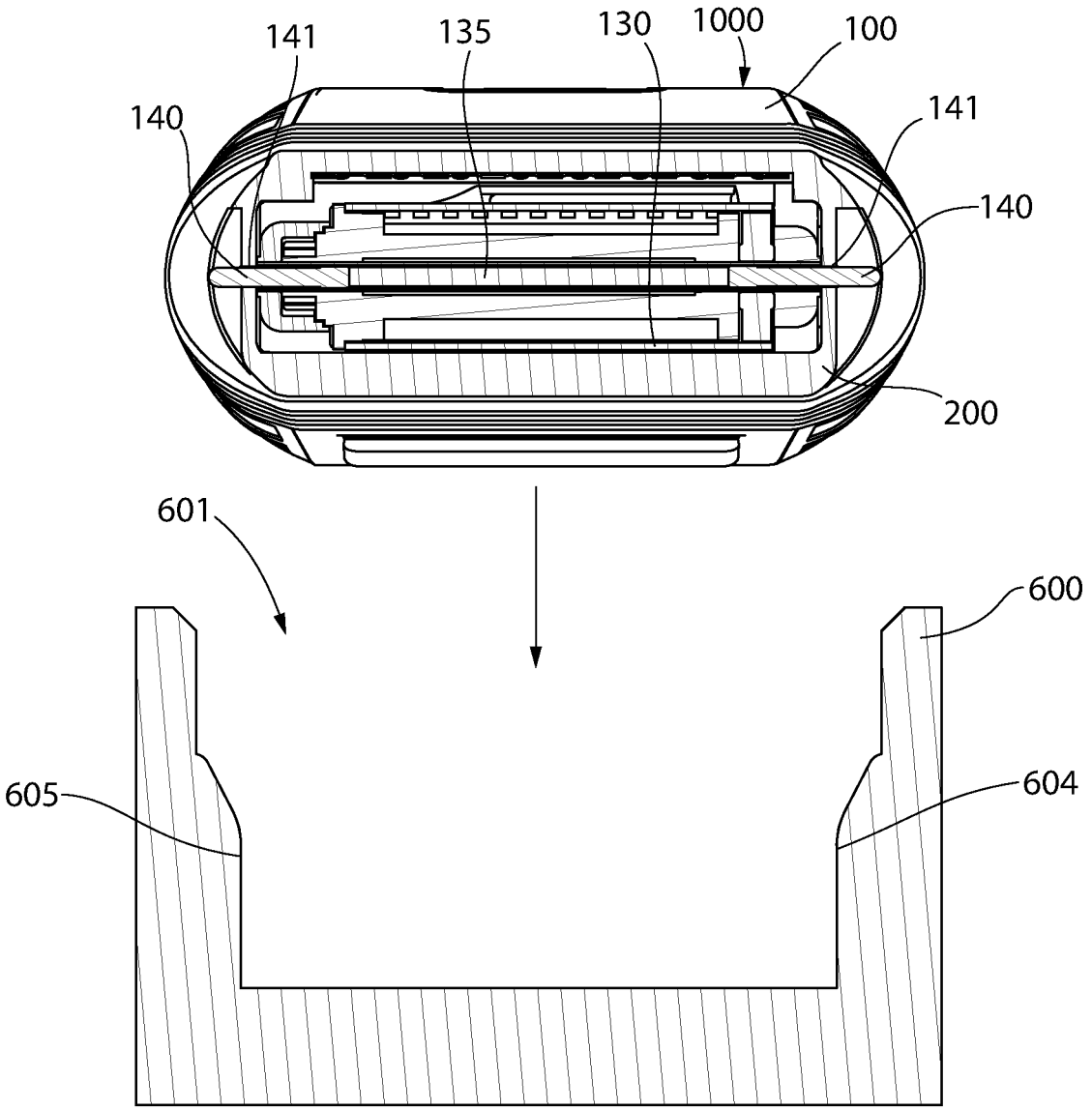
FIG. 19A is a cross-sectional view taken along line XIXA-XIXA of FIG. 18.
Figure 19B:
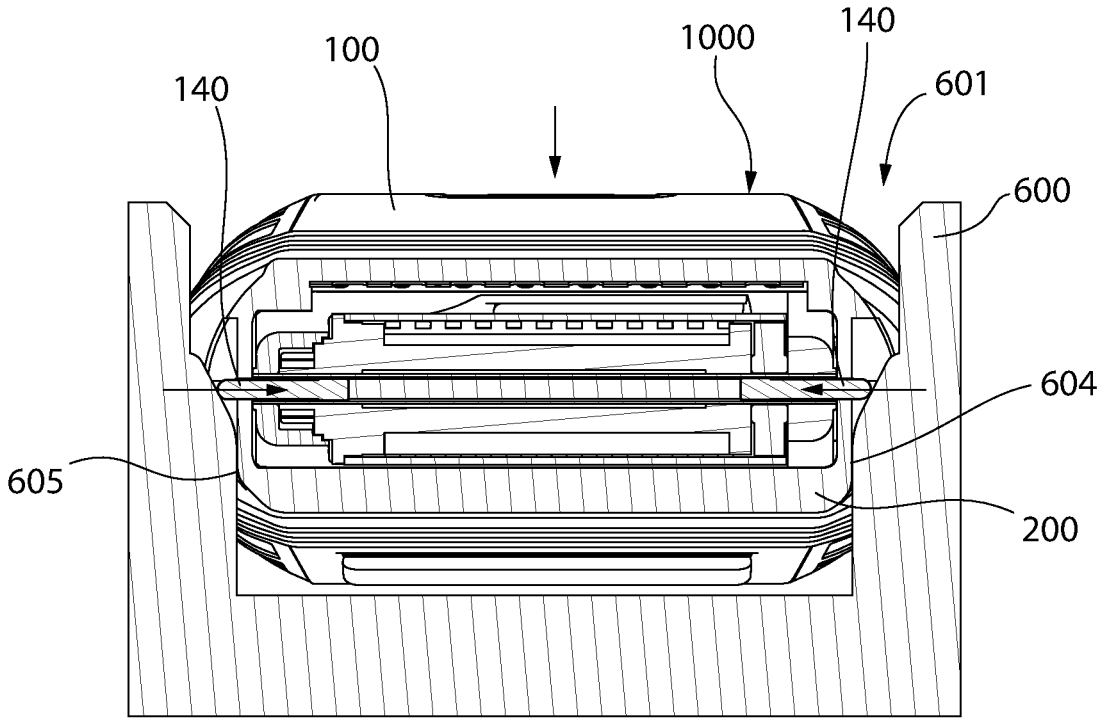
FIG. 19B-19C illustrate utilizing the refill blade assembly cartridge to remove the refill blade assembly from the base portion of the shaving apparatus.
Figure 19C:
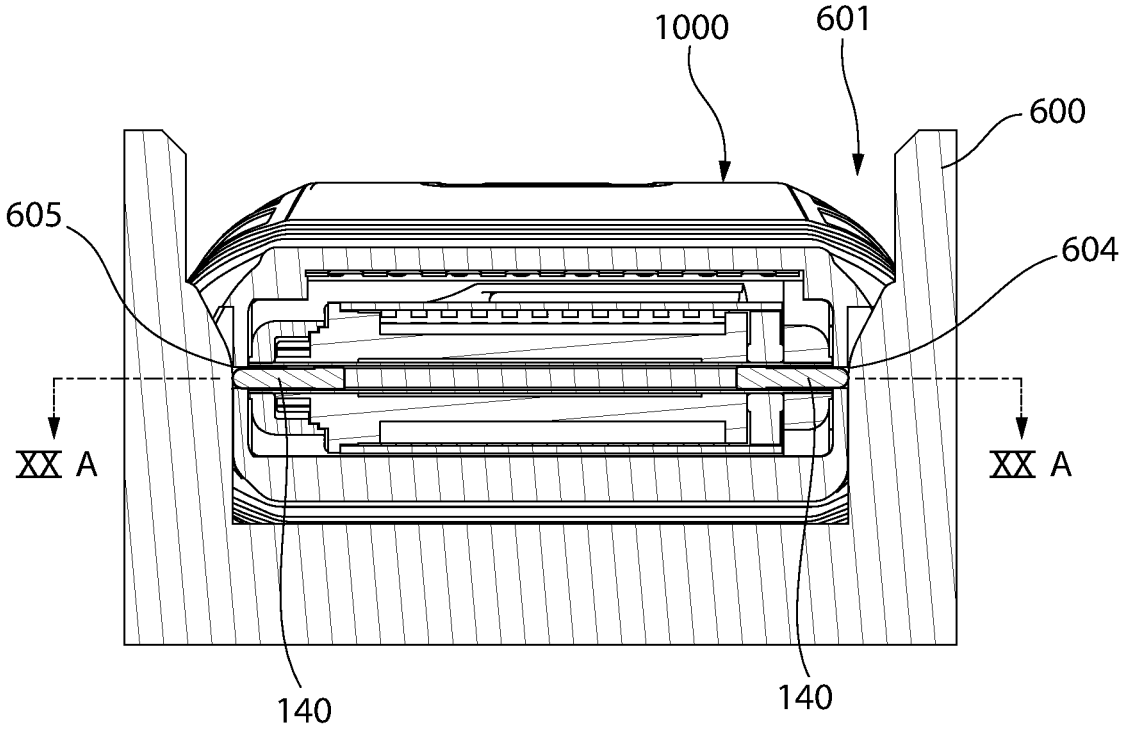

Referring to FIGS. 17 and 18 and also FIGS. 19A-20B in succession, use of the cartridge 600 to detach the refill blade assembly 200 of the shaving apparatus 1000 from the base portion 100 of the shaving apparatus 1000 is illustrated and described. First, the shaving apparatus 1000 is aligned with a top of one of the slots 601 as shown in FIGS. 18 and 19A. Then, the shaving apparatus 1000 is moved into the slot 601 in the direction of the axis I-I. When the shaving apparatus 1000 is positioned in one of the slots 601, the spring pins 140 are aligned with the flanges 604, 605. Furthermore, due to the variation in the length of the flanges 604, 605 as they extend from the upstanding walls 602, 603, as the shaving apparatus 100 is moved further and further into the slots 601 (see FIG. 19B and then FIG. 19C), the flanges 604, 605 apply a force onto the spring pins 140.

Figure 20A:
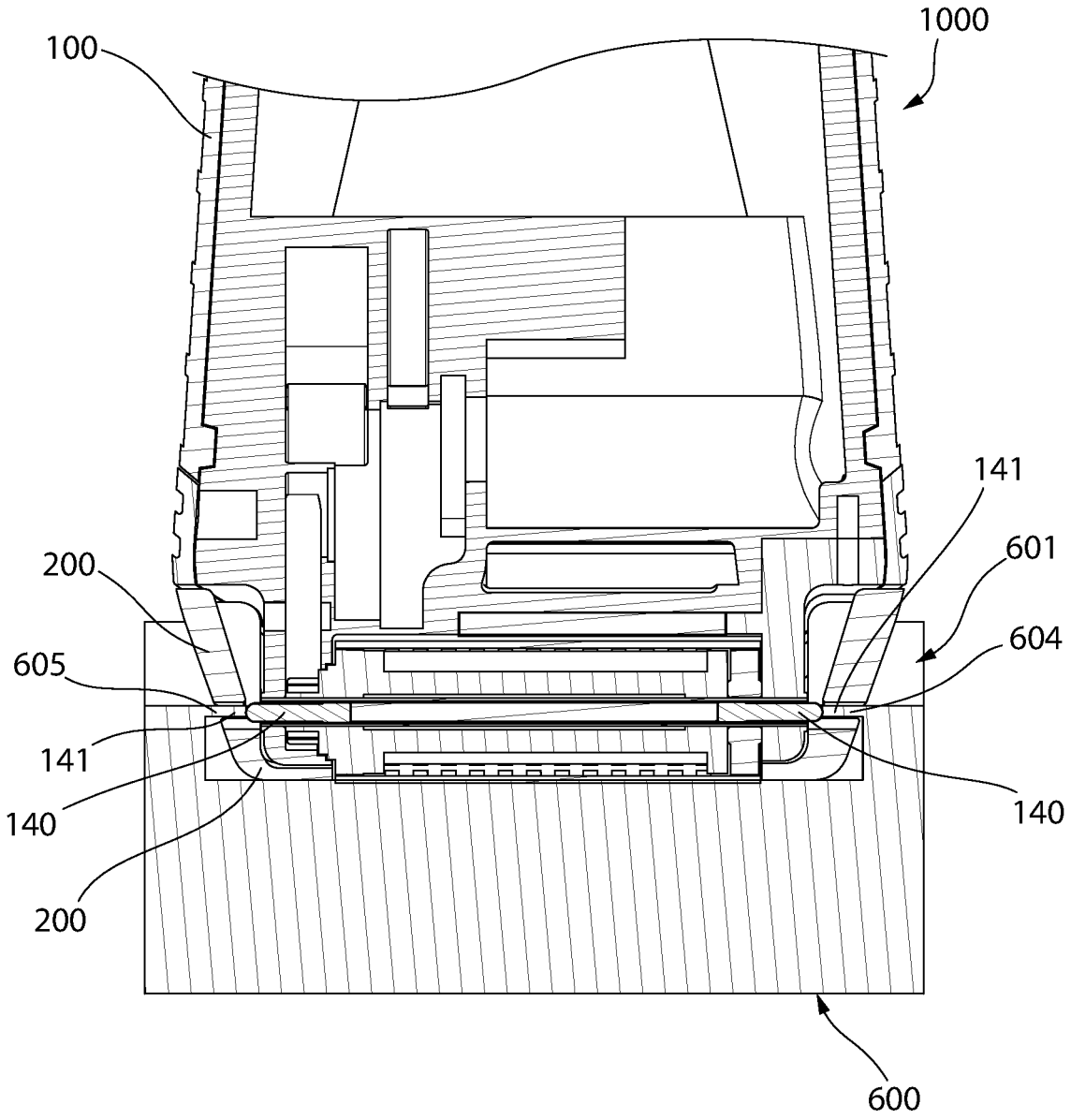
FIG. 20A is a cross-sectional view taken along line XXA-XXA of FIG. 19C.
Figure 20B:
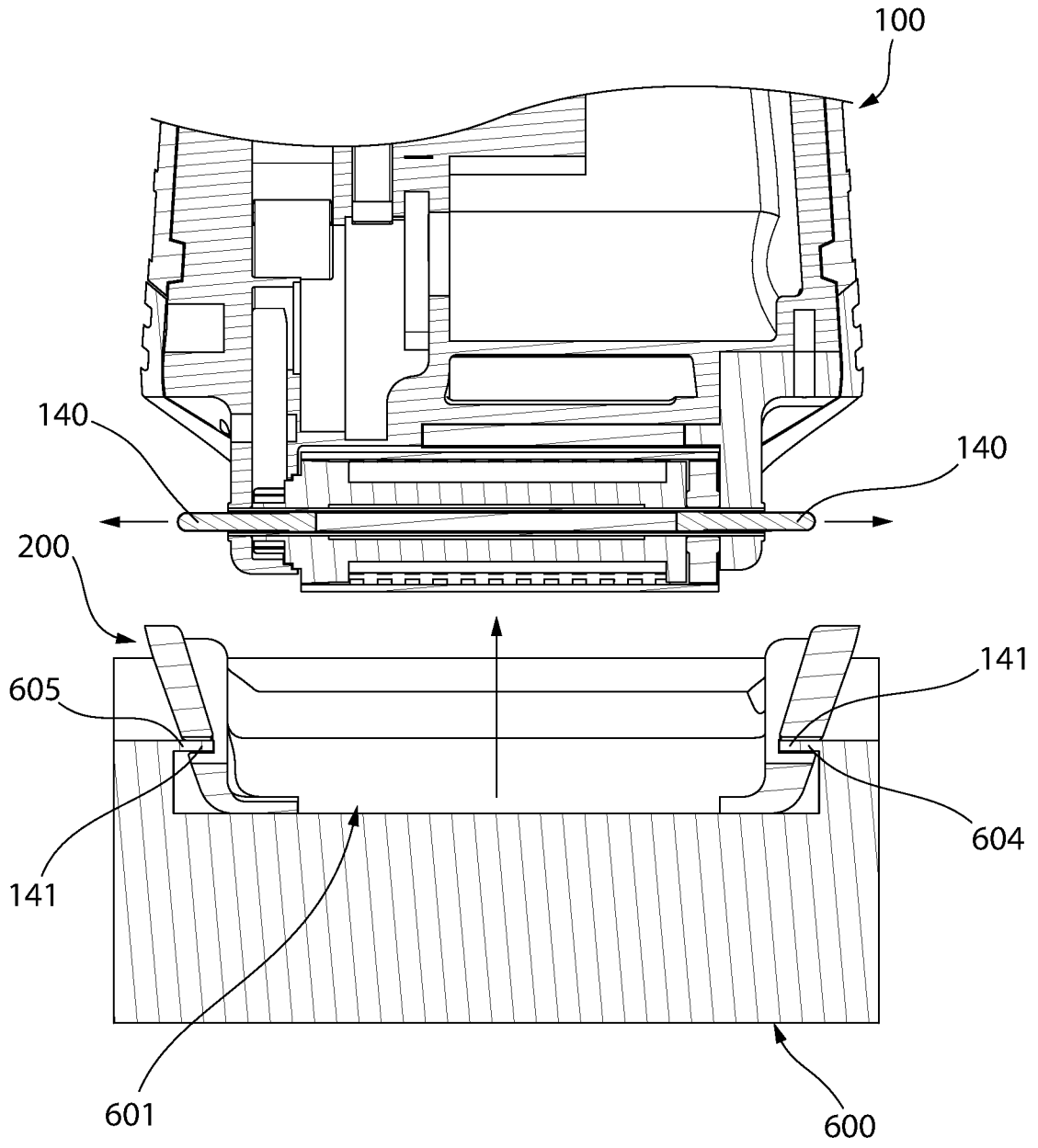
FIG. 20B is a cross-sectional view taken along line XXA-XXA of FIG. 19C with the body portion of the shaving apparatus removed from the refill blade assembly cartridge.
Figure 21:
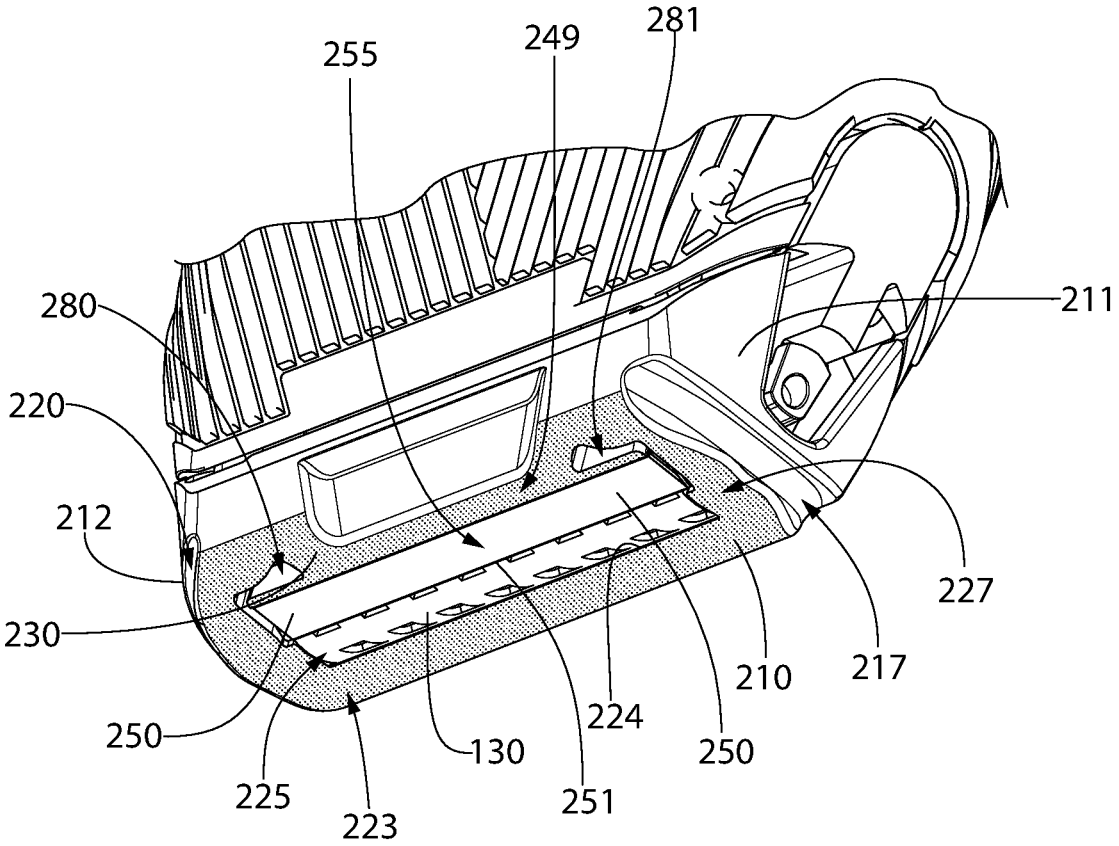
FIG. 21 is a perspective view of a portion of the shaving apparatus of FIG. 1 with a working surface of the refill blade assembly highlighted.

As best seen in FIGS. 20A and 20B, when the flanges 604, 605 engage the spring pins 140, the flanges 604, 605 enter into the openings 141 in the refill blade assembly 200. Once the shaving apparatus 1000 is adjacent to the bottom wall 606 of the slot 601 of the cartridge 600, the shaving apparatus 1000 is pulled upwardly out of the slot 601 in a direction of axis J-J (FIG. 18), which is perpendicular to the axis I-I. During this movement of the shaving apparatus 1000, due to the engagement of the flanges 604, 605 with the openings 141 in the refill blade assembly 200, the refill blade assembly 200 remains located within the slot 601 while the base portion 100 of the shaving apparatus 1000 is removed from the slot 601. In this manner, the cartridge 600 is used to detach the refill blade assembly 200 from the base portion 100 of the shaving apparatus 1000. Furthermore, following the above in reverse order, the refill blade assembly 200 may be attached to the base portion 100 of the shaving apparatus 1000.

It should be appreciated that the various structures of the shaving apparatus 1000 and the cartridge 600 that permit the cartridge 600 to be used for detaching the refill blade assembly 200 from the base portion 100 of the shaving apparatus 1000 is merely one embodiment thereof, and variations, permutations, and modifications are possible. Thus, in some embodiments the cartridge 600 may merely be a device that is configured to hold one or more of the refill blade assemblies 200 while also being configured to attach the refill blade assemblies 200 to the base portion 100 and detach the refill blade assemblies 200 from the base portion 100 of the shaving apparatus 1000.

Figure 22:
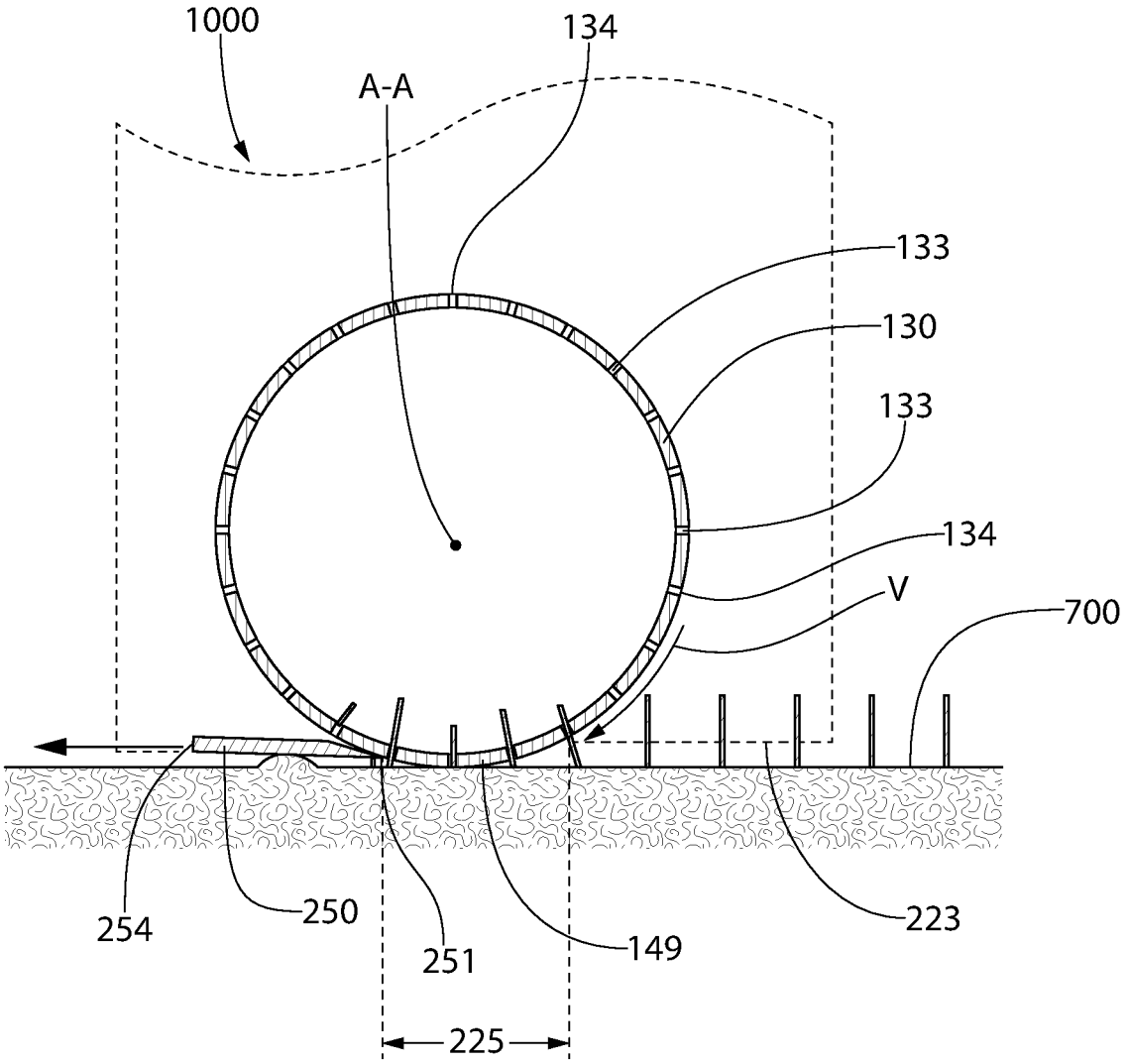
FIG. 22 is a schematic view illustrating a shaving apparatus being moved across a user's hair-covered skin surfaces in a direction opposite a cutting edge of a blade of the shaving apparatus.

Referring now to FIG. 22, a method of shaving using the shaving apparatus 1000 will be described. The shaving apparatus 1000 is illustrated generically in FIG. 22, but it should be appreciated that the shaving apparatus 1000 described in any of the embodiments above may be used in accordance with the method of shaving disclosed herein.

The shaving apparatus 1000 comprises the rotary cutter 130 and the blade 250 as described herein above. The rotary cutter 130 comprises a plurality of cutting edges 134. In the exemplified embodiment, the cutting edges 134 define a plurality of closed-geometry apertures 133 as discussed above. The blade 250 comprises the cutting edge 251 and a rear edge 254 opposite the cutting edge 251. As shown in FIG. 22, during use the rotary cutter 130 is rotated about the rotational axis A-A, in the exemplified embodiment in a clockwise direction V, and a user's hairs are sheared between the cutting edge 251 of the blade 250 and the cutting edges 134 of the rotary cutter 130. The rotary cutter 130 may rotate in an opposite direction, but in one embodiment the rotary cutter 130 rotates in a singular angular direction during use. During use, the user's hairs enter into the apertures 133 of the rotary cutter 130 and are then sheared as the apertures 133 of the rotary cutter 130 and the cutting edges 134 that define the apertures 133 come into contact with the cutting edge 251 of the blade 250.

As discussed above, the cutting edge 251 of the blade 250 at least partially defines the work window 225. Furthermore, in the exemplified embodiment the work window 225 is defined by the cutting edge 251 of the blade 250 and an edge 224 of the cover member 210 of the refill blade assembly 200 (the edge 224 is not called out in FIG. 22 due to the schematic illustration, but the previously described figures provide a good illustration of the edge 224). The edge 224 of the cover member 210 of the refill blade assembly 200 is not a cutting edge of the shaving apparatus 1000. Furthermore, the edge 224 of the cover member 210 is not in sufficient contact with the rotary cutter 130 for it to facilitate shearing of a user's hairs. As seen, the rotary cutter 130 is at least partially exposed via the work window 225.

To cut a user's hairs, first the working surface 223 of the shaving apparatus 1000, which comprises the blade 251, is positioned against a skin surface 700. With the working surface 223 of the shaving apparatus 100 pressed against the skin surface 700, the working surface 223 is moved across the skin surface 700 so that the cutting edge 251 of the blade 250 is a trailing edge of the blade 250. Specifically, the working surface 223 is moved across the skin surface 700 with the rear edge 254 of the blade 250 leading and the cutting edge 251 trailing. Stated another way, the cutting edge 251 of the blade 250 faces a first direction, and during use the working surface 223 of the shaving apparatus 1000 is moved in a second direction substantially opposite the first direction. In certain embodiments, the direction of moving is substantially parallel to a tangential velocity of an apex portion 149 of the rotary cutter 130 that protrudes through the work window 225. The rotary cutter 130 may protrude through the work window 225 a few microns and up to approximately 0.2 mm. During this movement of the working surface 223 across the skin surface 700, the user's hairs are sheared between the cutting edge 251 of the blade 250 and the cutting edges 134 of the rotary cutter 130. Thus, shearing occurs despite the fact that the cutting edge 251 of the blade 250 is not the leading edge during shaving.

An advantage of moving the shaving apparatus 1000 across the skin surface 700 with the dull edge (i.e., the rear edge 254) of the blade 250 facing forward is that it eliminates running the cutting edge 251 of the blade 250 directly into skin tags, moles, scars, and other protuberances that extend from the skin surface 700. When the cutting edge 251 of the blade 250 is the leading edge during cutting, the cutting edge 251 may cut or bruise the skin during use such as by cutting off skin tags and the like that are connected to and extend from the skin surface 700. This same negative result does not occur when the dull rear edge 254 of the blade 250 is the leading edge during movement of the working surface 225 across the skin surface 700. In fact, as understood when viewing FIG. 22 in combination with, for example, FIGS. 7A-7C, the dull rear edge 254 of the blade 250 is surrounded/enclosed by the plastic material of the refill blade assembly 200. Thus, the dull rear edge 254 of the blade 250 does not, and in fact can not, scrape the skin.

The reason that the shaving apparatus 1000 will still operate effectively even while the cutting edge 251 of the blade 250 is the trailing edge is because the rotary cutter 130 operates as a shoving mechanism in that it pushes the hair to be cut towards the cutting edge 251 of the blade 250. The "shoving force" applied by the rotary cutter 130 includes a force vector component that is perpendicular to the cutting edge 251 of the blade 250, facing the cutting edge 251 of the blade 250, and in the same plane as the cutting edge 251 of the blade 250. In this system, the cutting process is not dependent on the movement or direction of movement of the cutting edge 251 of the blade 250. Rather, as long as there are hairs in the work window 225, they will enter the apertures 133 in the rotary cutter 130 and be shoved towards the cutting edge 251 of the blade 250 and sheared. Thus, the shearing is only dependent on the motion of the rotary cutter 130 and not on direction of movement of the working surface 223 of the shaving apparatus 1000 along the skin surface 700.

Although the method is described above with regard to moving the working surface 225 across the skin surface 700 in a direction opposite the facing direction of the cutting edge 251 of the blade 250, the invention is not to be so limited in all embodiments. The shaving apparatus 1000 can also be used by moving the working surface 225 across the skin surface 700 in the direction of the cutting edge 251 of the blade 250 (with the cutting edge 251 of the blade 250 as the leading edge during cutting rather than the trailing edge). However, movement in this direction risks the cutting edge 251 of the blade 250 cutting non-flat skin forms such as sores, dimples, moles, folds, and other skin projections and damaging the user's skin whereas moving in the direction opposite the cutting edge 251 of the blade 250 as shown in FIG. 22 will result in the blade 250 gliding over the skin including any non-flat skin forms without cutting or damaging the skin while still shearing the hairs and whiskers extending from the skin surface 700.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A shaving apparatus comprising:

a rotary cutter comprising a plurality of cutting edges;

a blade having a cutting edge, the blade mounted to a spring member, the blade biased into contact with the rotary cutter by the spring member;

an electric motor operably coupled to a power source and the rotary cutter to rotate the rotary cutter about a rotational axis so that a user's hairs are sheared between the cutting edge of the blade and the cutting edges of the rotary cutter; and wherein the spring member comprises a cantilever, the blade mounted on the cantilever.

2. The shaving apparatus according to claim 1 wherein the cutting edge of the blade extends beyond a free end of the cantilever.

3. The shaving apparatus according to claim 1 wherein the rotary cutter comprises a cutter tube that comprises a plurality of closed-geometry apertures in an outer surface of the cutter tube, each of the closed-geometry apertures defined at least in part by the cutting edges of the rotary cutter.

4. The shaving apparatus according to claim 3 wherein the blade is biased into contact with the outer surface of the cutter tube.

5. The shaving apparatus according to claim 4 wherein the outer surface of the cutter tube defines a reference cylinder in which the cutting edges of the rotary cutter at least partially lie, the cutting edge of the blade contacting the reference cylinder.

6. The shaving apparatus according to claim 1 further comprising:

a base portion, the rotary cutter mounted to the base portion so as to be rotatable relative to the base portion about the rotational axis;

a cover member, the spring member connected to the cover member so that the cutting edge of the blade at least partially defines a work window; and the cover member coupled to the base portion so that a portion of the rotary cutter is exposed via the work window.

7. The shaving apparatus according to claim 6 wherein the spring member is integrally formed with the cover member.

8. The shaving apparatus according to claim 7 wherein the spring member is defined by first and second notches that extend from the work window on opposite sides of the spring member.

9. The shaving apparatus according to claim 8 wherein each of the first and second notches is a multi-directional notch comprising a first section extending away from the work window and a second section extending toward a transverse centerline of the cover member.

10. The shaving apparatus according to claim 9 wherein the second sections of the first and second notches define a strut portion of the spring member therebetween, and wherein the cantilever has a length that is greater than a length of the strut portion.

11. The shaving apparatus according to claim 7 wherein the spring member and the cover member are formed as a monolithic structure from the same material.

12. The shaving apparatus according to claim 7 wherein the spring member comprises an upstanding wall and a floor extending from the upstanding wall, the blade mounted to the floor and having a rear edge that abuts the upstanding wall of the spring member.

13. A refill blade assembly configured for detachable coupling to and from a shaving apparatus having a base portion, a rotary cutter having a plurality of cutting edges mounted to the base portion so as to be rotatable relative to the base portion about a rotational axis, and an electric motor operably coupled to a power source and the rotary cutter to rotate the rotary cutter about the rotational axis, the refill blade assembly comprising:

a cover member;

a spring member, a blade mounted to the spring member, the blade having a cutting edge;

the spring member connected to the cover member so that the cutting edge of the blade at least partially defines a work window;

the spring member is configured such that when the refill blade assembly is attached to the base portion, the blade is biased into contact with the rotary cutter by the spring member; and wherein the spring member comprises a cantilever, the blade mounted on the cantilever.

14. The refill blade assembly according to claim 13 wherein the cutting edge of the blade extends beyond a free end of the cantilever.

15. The refill blade assembly according to claim 13 wherein the spring member is integrally formed with the cover member.

16. A refill blade assembly configured for detachable coupling to and from a shaving apparatus having a base portion, a rotary cutter having a plurality of cutting edges mounted to the base portion so as to be rotatable relative to the base portion about a rotational axis, and an electric motor operably coupled to a power source and the rotary cutter to rotate the rotary cutter about the rotational axis, the refill blade assembly comprising:

a cover member;

a spring member, a blade mounted to the spring member, the blade having a cutting edge;

the spring member connected to the cover member so that the cutting edge of the blade at least partially defines a work window;

the spring member is configured such that when the refill blade assembly is attached to the base portion, the blade is biased into contact with the rotary cutter by the spring member;

wherein the spring member is integrally formed with the cover member; and wherein the spring member is defined by first and second notches that extend from the work window on opposite sides of the spring member.

17. The refill blade assembly according to claim 16 wherein each of the first and second notches is a multi-directional notch comprising a first section extending away from the work window and a second section extending toward a transverse centerline of the cover member.

* * * * *